US006112395A

United States Patent [19]

Quick et al.

[11] Patent Number: 6,112,395

[45] **Date of Patent: *Sep. 5, 2000**

[54] PROCESS OF MAKING FINE AND ULTRA FINE METALLIC FIBERS

[75] Inventors: Nathaniel R. Quick, Lake Mary; Michael Liberman; Alexander Sobolevsky, both of Deland; Raymond R. McNeice, Debary, all of Fla.

[73] Assignee: USF Filtration and Separations Group, Inc., Timonium, Md.

[ * ] Notice: This patent is subject to a terminal disclaimer.

[21] Appl. No.: 09/190,723

[22] Filed: Nov. 12, 1998

Related U.S. Application Data

[60] Provisional application No. 60/065,363, Nov. 12, 1997.

[51] Int. Cl.[7] ..... B23P 17/00

[52] U.S. Cl. ..... 29/419.1; 29/423; 29/424; 29/DIG. 11

[58] Field of Search ..... 29/419.1, 423, 29/424, DIG. 11

[56] References Cited

U.S. PATENT DOCUMENTS

| | | |
|---|---|---|
| Re. 28,526 | 8/1975 | Ziemak . |
| 2,050,298 | 8/1936 | Everett . |
| 2,077,682 | 4/1937 | Everett . |
| 3,066,384 | 12/1962 | Heger . |
| 3,204,326 | 9/1965 | Granitsas . |
| 3,277,564 | 10/1966 | Webber et al. . |
| 3,375,569 | 4/1968 | Eichinger et al. . |
| 3,378,916 | 4/1968 | Robinson . |
| 3,394,213 | 7/1968 | Roberts et al. . |
| 3,540,114 | 11/1970 | Roberts et al. . |
| 3,550,247 | 12/1970 | Evans et al. . |
| 3,596,349 | 8/1971 | Boom et al. . |
| 3,762,025 | 10/1973 | Gottlieb et al. . |
| 3,785,036 | 1/1974 | Tada et al. . |
| 3,807,026 | 4/1974 | Takeo et al. . |
| 3,882,587 | 5/1975 | Schneider et al. . |
| 3,894,675 | 7/1975 | Klebl et al. . |
| 3,945,555 | 3/1976 | Schmidt . |
| 4,044,447 | 8/1977 | Hamada et al. . |
| 4,065,046 | 12/1977 | Roberts et al. . |
| 4,109,870 | 8/1978 | Wolber . |
| 4,118,845 | 10/1978 | Schildbach . |
| 4,156,500 | 5/1979 | Yoshida et al. . |
| 4,166,564 | 9/1979 | Wolber . |
| 5,181,549 | 1/1993 | Shapovalov . |
| 5,890,272 | 4/1999 | Liberman et al. ..... 29/419.1 |

*Primary Examiner*—David P. Bryant
*Attorney, Agent, or Firm*—Frijouf, Rust & Pyle, P.A.

[57] ABSTRACT

A process is disclosed for making fine metallic fibers comprising forming a continuous tube about a plurality of coated metallic wires for providing a first cladding. The first cladding is drawn for reducing the outer diameter and for diffusion welding the coating within the cladding. The tube is mechanically removed to provide a first remainder. The first remainder is drawn for reducing the diameter thereof to transform the plurality of metallic wires into a plurality of fine metallic fibers. In one example, the diffusion welded coating is removed for providing the plurality of fine metallic fibers. In another example, a plurality of the first remainders are assembled and a continuous tube is formed about a the first remainders for providing a second cladding. The second cladding is drawn for reducing the outer diameter. The tube is mechanically removed to provide a second remainder. The second remainder is drawn for reducing the diameter thereof to transform the plurality of fine metallic fibers into a plurality of ultra fine metallic fibers. The diffusion welded coating is removed for providing the plurality of ultra fine metallic fibers.

26 Claims, 24 Drawing Sheets

PROCESS OF MAKING FINE AND ULTRA FINE METALLIC FIBERS

CROSS-REFERENCE TO RELATED APPLICATIONS

This application claims benefit of U.S. Provisional application serial No. 60/065,363 filed Nov. 12, 1997. All subject matter set forth in application serial No. 60/065,363 is hereby incorporated by reference into the present application as if fully set forth herein.

BACKGROUND OF THE INVENTION

1. Field of the Invention

This invention relates to metallic fibers and more particularly to an improved method of making fine and ultra fine metallic fibers through a new cladding and drawing process.

2. Background of the Invention

In recent years, the need for high quality, small diameter metallic fibers has grown as new applications for such fibers are developed by the art. High quality, small diameter metallic fibers have been used in diverse applications such as filtration media as well as being dispersed within a polymeric material to provide electrostatic shielding for electronic equipment and the like. This need for high quality, small diameter metallic fibers has produced various new ways and processes for making these high quality metallic fibers for the various uses in the art.

Typically, high quality metallic fibers may be characterized as small diameter metallic fibers having a diameter of less than 50 micrometers with a substantially uniform diameter along the longitudinal length thereof. Typically, the fibers are produced in a fiber tow and severed to have a longitudinal length at least 1,000 times the diameter of the metallic fiber.

The metallic fibers as set forth herein are typically manufactured by cladding a metallic wire with a cladding material to provide a first cladding. The first cladding is drawn and annealed for reducing the diameter of the first cladding. A plurality of the first claddings are clad to provide a second cladding. The second cladding is subjected to a multiple drawing and annealing process for reducing the diameter of the second cladding and the corresponding diameter of the first claddings contained therein. Depending upon the desired end diameter of the first cladding, the plurality of second claddings may be clad to provide a third cladding. Multiple drawings of the third cladding reduces the diameter of the first and second claddings to provide metallic fibers within the first claddings of the desired diameter. After the desired diameter of the metallic fibers within the first cladding is achieved, the cladding materials are removed by either an electrolysis or a chemical process thereby providing metallic fibers of the desired final diameter.

Ideally, the metallic fibers are made of a stainless steel and are produced by a drawing process. The drawing process comprises cladding a stainless steel wire with a cold roll steel clad material to produce a first cladding. The first cladding is subjected to a series of drawing and annealing processes for reducing the diameter thereof. Thereafter, a plurality of the first claddings are encased within a second cladding material such as cold roll steel for producing a second cladding. The second cladding is subjected to a series of drawing and annealing processes for further reducing the diameter of the second cladding. After the second drawing process, the original wires of the first cladding are reduced to a diameter of 10 to 50 microns that is suitable for some applications. For applications requiring finer metallic fibers, a plurality of second claddings are clad with a third cladding material to provide a third cladding. Third cladding is subjected to a series of drawing and annealing for further reducing the diameter of the original metallic wires. A triple cladding process can produce final wires having a diameter of as low as 6 microns in diameter.

The cladding material is removed by subjecting the finally drawn cladding to an acid leaching process whereby the acid dissolves the cladding material leaving the metallic fibers. The metallic fibers may be severed to produce metallic sliver or cut metallic fibers or may be used as metallic fiber tow.

Although the foregoing process of making fine metallic fibers has been found satisfactory in the prior art, the process has certain disadvantages for some applications. The first disadvantage is the requirement of incorporating a three cladding process in order to produce metallic fibers in the range of 6 microns in diameter. Another limitation is the initial diameter of the metallic wire must be of a sufficient size in order to clad carbon steel thereto. Another disadvantage of the aforementioned process includes the incomplete removal of the cladding material from the metallic fibers during the leaching process.

Another disadvantage of this prior art process is the diffusion of impurities of the carbon steel into the metallic fibers during the drawing process. A substantial amount of heat and pressure are produced during the drawing process causing a fusion of undesirable materials from the carbon steel upon the surface of the metallic fibers. These undesirable materials such as carbon, hydrocarbon materials such as oils and the like remain on the surface of the metallic fibers through the leaching process and reside thereon in the end product. In certain applications, these undesired impurities are detrimental to the application and the use of the metallic fibers. For example, these undesirable impurities may be detrimental when the metallic fibers are used in a filtration process or the like.

Some of the prior art have attempted to use copper as a cladding material for producing fine metallic fibers. U.S. Pat. No. 2,050,298 to Everett discloses a method for producing filaments from a rod, which comprises the steps of bundling the rods side by side in a matrix, drawing the bundle, removing the matrix, and separating the wires. The matrix serves to separate the elements, limiting distortion during drawing and preventing adjacent elements from becoming attached to each other. Two embodiments of matrix material given are metal powder and individual metal sheaths, or a combination of the two. The sheath may be dissolved off with acid. An example given consisted of stainless steel fibers having a copper matrix and a tubular casing of high carbon steel, the removal of which was effected by a hot acid bath. An alternative method for stainless steel fibers consisted of encasing the fibers in separate copper tubes and then packing a number of these in a copper tube.

U.S. Pat. No. 2,077,682 discloses a process for the production of fine wires, strips, thin sheets or the like by reduction from elements of larger cross-section which comprises assembling inside a tubular casing a plurality of metal elements composed of alloy steel comprising 0.05% to 0.20% carbon, 6% to 14% nickel and 10% to 20% chromium, and subjecting the encased elements as a unit to reducing operations to reduce the cross-section area of all the elements, simultaneously, and then removing the casing.

U.S. Pat. No. 3,066,384 discloses a method of making from 80" wide to 160" wide thin sheets of a metal which is difficult to roll selected from the group consisting of stainless steel, ferrous alloys, titanium, zirconium and their alloys, which consists in assembling a pack of plates of the metal with weld-preventing material therebetween, placing the pack within a box welded up from steel top and bottom plates and steel side and end bars with the top and bottom plates overlapping the side and end bars, providing vent holes in all of the bars, hot rolling the resulting pack-in-a-box first by cross rolling and then by rolling longitudinally, thereby reducing the first-mentioned plates to sheets, then subjecting the sheets while still confined within the box to heating and cooling stages in predetermined order thereby developing desired physical properties in the sheets, roller leveling the hot-rolled pack while still in the box, and then opening the box and removing and separating the sheets.

U.S. Pat. No. 3,204,326 discloses a method of making a fused energy-conducting structure having a multiplicity of juxtaposed long and thin energy-conducting guides extending from one end toward the other end thereof utilizing a rolling mill, the method comprising the steps of placing a multiplicity of energy-conducting fibers each clad with a glass having a relatively low softening temperature and coefficient of expansion in side-by-side bundled relationship longitudinally within a tubular supporting member formed of a metal having a substantially higher softening temperature and coefficient of expansion than the glass, the fibers being in such number and of such diameter as to substantially fill the supporting member, there being undesired interstices containing air and gases extending longitudinally between the fibers, heating the assembly of the supporting member and fibers to a temperature sufficient to soften and fuse claddings together and rolling the heated assembly under compression progressively from one end toward the other end thereof to a reduced cross-sectional size, the reduction in size being of an amount at least sufficient to effect substantially complete closure of the interstices progressively along the length of the assembly and simultaneous longitudinal extrusion of air and gases therein immediately prior to adjoining and fusion of portions of the claddings along the interstices as the assembly is rolled.

U.S. Pat. No. 3,277,564 discloses a method of forming a tow of substantially bare filaments comprising the steps of sheathing each of a plurality of elongated drawable metal elements from which the filaments are to be formed with a tubular sheath formed of a material having characteristics permitting the sheaths to be pressed together to form a substantially monolithic body and differing chemically substantially from those of the elements to permit separation of the sheath material from elements. The sheathed elements are bundled in a substantially parallel relationship. The bundled sheathed elements are mechanically worked in at least one working step to reduce the cross-section of the elements to a preselected filament cross-section of less than approximately 10 microns maximum transverse dimension and to cause the sheath material to form a matrix extending substantially continuously in cross-section thereby to preclude separation of individual sheathed filaments. The sheathing material is substantially completely removed while maintaining the filaments in bundled relationship to provide a tow of substantially bare separate filaments.

U.S. Pat. No. 3,378,916 discloses a method of process for the production of superconducting niobium-zirconium alloy wire comprising heat-treating a niobium-zirconium material containing a second phase constituent and having a substantially non-dendritic refined crystal structure substantially free of high concentrations of impurities, in a temperature range of 1000°–1250° C. under inert conditions for 30–120 minutes, whereby the second phase is placed in solution with the material. The process includes quenching the material as quickly as possible to retain the second-phase constituents in solution and working the material at a temperature below 500° C. to reduce its cross section and removing any surface defects which may be present. The material is heat-treated at a temperature in the range of 750° C.–825° C. under inert conditions for 15–130 minutes and is enclosed within a sheath of different material having substantially similar working properties to the material regarding ductility, rate of work-hardening and hardness. The material is deformed within the sheath together to the required final cross-section of the material. The sheath is dissolved and the material is copper plated.

U.S. Pat. No. 3,394,213 discloses a method of forming fine filaments, such as filaments of under approximately 15 microns, in long lengths wherein a plurality of sheathed elements are firstly constricted to form a reduced diameter billet by means of hot forming the bundled filaments. After the hot forming constriction, the billet is then drawn to the final size wherein the filaments have the desired final small diameter. The material surrounding the filaments is then removed by suitable means leaving the filaments in the form of a tow.

U.S. Pat. No. 3,503,200 to Roberts et al. provides a method of forming a twisted bundle of filaments wherein a plurality of sheathed filaments are bundled together, sheathed or embedded in a matrix, and constricted by being drawn through a constricting die. Then the bundle is fed onto a roll, with a twist imparted to the filaments at the same time.

U.S. Pat. No. 3,540,114 discloses a method of forming fine filaments formed of a material such as metal by multiple end drawing a plurality of elongated elements having thereon a thin film of lubricant material. The plurality of elements may be bundled in a tubular sheath formed of a drawable material. The lubricant may be applied to the individual elements prior to the bundling thereof and may be provided by applying the lubricant to the elements while they are being individually drawn through a coating mechanism such as a drawing die. The lubricant comprises a material capable of forming a film having a high tenacity characteristic whereby the film is maintained under the extreme pressure conditions of the drawing process. Upon completion of the constricting operation, the tubular sheath is removed. If removed, the lubricant may also be removed from the resultant filaments.

U.S. Pat. No. 3,550,247 discloses carbon filaments being coated with a metal by electrodeposition, electroless plating or chemical plating. Preferably the carbon filaments are subjected to an oxidizing treatment under strong oxidizing conditions before being coated with the metal. Metal coated filaments are incorporated in the metal matrix by electroforming, powder technology techniques, casting or by subjecting the coated filaments to a combination of heat and pressure to coalesce them into a composite material.

U.S. Pat. 3,596,349 discloses a method of fabricating a unitary superconducting multistrand conductor. The method includes coating a plurality of fine superconducting wires with a normal metal having ductility characteristics similar with those of the superconducting metal, assembling the coated wires in a close-packed array, and swagging the array so that the metal coatings of the wires form a conductive continuous matrix in which the wires are solidly embedded.

U.S. Pat. No. 3,762,025 discloses a process for producing long continuous lengths of metallic filaments which comprises securing four flat plates of a first metal to each of the elongated sides of a billet of a second metal and having a cross section in shape of a rectangle, by edge welding each of the plates. The resulting assembly is essentially void free. The rectangular cross section of the billet is reduced while being elongated by hot rolling. The resulting elongated rectangular structure, having a core of the second metal and a cladding of the first metal over the elongated sides, is divided into a plurality of elements of the same lengths. The elements are inserted into a hollow metal tube open at both ends having a rectangular cross section in a manner to essentially eliminate the voids and with their longitudinal axes and the longitudinal axis of the tube essentially parallel. Ends of the tube are sealed and the sealed unit is reduced in cross section and elongated by hot rolling. The other materials are removed from the resulting filaments of the first metal yielding materials suitable for weaving into metal cloth.

U.S. Pat. No. 3,785,036 discloses a method of producing fine metallic filaments by covering a bundle of a plurality of metallic wires with an outer tube metal and drawing the resultant composite wire, wherein the outer tube metal on both sides of the final composite wire obtained after the drawing step is cut near to the core filaments present inside the outer tube and then both uncut surfaces of the composite wire are slightly rolled thereby to divide the outer tube metal of the composite wire continuously and thus separating the outer tube metal from fine metallic filaments. The separation treatment can be effected by a simple apparatus within a short time This reduces the cost of production, and enables the outer tube metal to be recovered in situ.

U.S. Pat. No. 3,807,026 discloses a method of producing a yarn of fine metallic filaments at low cost, which comprises covering a bundle of a plurality of metal wires with an outer tube metal to form a composite wire, drawing the composite wire and then separating the outer tube metal from the core filaments in the composite wire, wherein for ease of the separation treatment, the surfaces of the metal wires are coated with a suitable separator or subjected to a suitable surface treatment before the covering of the outer tube metal, thereby to prevent the metallic bonding of the core filaments to each other in the subsequent drawing or heat-treatment of the composite wire.

U.S. Pat. No. 4,044,447 discloses a number of wires gathered together and bound with an armoring material in the shape of a band. The wires in this condition are drawn by means of a wire drawing apparatus having dies and a capstan. A plurality of bundles of such wires are gathered together and bound in the same way as in the foregoing to form a composite bundle body, which is further drawn, and these processes are repeated until at least filaments of a specific diameter are obtained in quantities.

U.S. Pat. No. 4,065,046 discloses a collimated hole structure formed by constricting a plurality of tubular elements each provided with a core for supporting the tubular element during the constricting operation. The bundle of elements is constricted to a point where the elements effectively fuse into a substantially monolithic body. The cores are then removed, leaving a plurality of extremely small diameter, generally parallel passages in a solid body. The tubular elements may be arranged in any desired array, and thus the passages may be provided similarly in any desired array. The passages may have high aspect ratios and may be closely juxtaposed. In one illustrative application, the collimated hole structure is provided with dielectric film and utilized as an anode portion of an electrolytic capacitor. In another illustrative application, the collimated hole structure is utilized as a tip for a drilling device.

U.S. Pat. No. 4,118,845 discloses a method of forming a tow of filaments and the two formed by the method wherein a bundle of elongated elements such as rods or wires, is clad by forming a sheath of material different from that of the elements about the bundle and the bundle is subsequently drawn to constrict the elements to a desired small diameter. The elements may be formed of metal. The bundle may be annealed, or stress relieved, between drawing steps as desired. The sheath may be formed of metal and may have juxtaposed edges thereof welded together to retain the assembly. The sheath is removed from the final constricted bundle to free the filaments in the form of tow.

U.S. Pat. No. RE 28,526 to Ziemek discloses a copper band formed around an aluminum core wire and the single seam in the sheath material is welded without bonding of the sheath and core, care being taken that all surfaces are clean and maintained free of oxides. The copper tube, is reduced to the diameter of the aluminum core. This composite wire is then passed through a plurality of drawing dies which reduce the diameter of the wire, preferably at least 50 percent, care being taken to prevent the copper sheath from tearing. The drawing operation produces, depending on the reduction rate, an initial or a complete bond between the core and sheath. Subsequently, the clad wire is either subjected to a limited diffusion heat treatment, conditions of the heat treatment being controlled to produce a complete and flawless bond between the sheath and core but, at the same time, avoiding the formation of an $CuAl_2$, a phase which is brittle or is annealed to get the required grade. Generally, the diffusion layer on either side of the sheathcore interface is limited to about $10\mu$.

U.S. Pat. No. 3,277,564 to Webber et al teaches a method of forming a tow of substantially bare filaments comprising the steps of sheathing each of a plurality of elongated drawable metal elements from which the filaments are to be formed with a tubular sheath formed of a material having characteristics permitting the sheaths to be pressed together to form a substantially monolithic body and differing chemically substantially from those of the elements to permit separation of the sheath material from elements when desired. The sheathed elements are bundled in substantially parallel relationship. The bundled sheathed elements are mechanically worked in at least one working step to reduce the cross-section of the elements to a preselected filament cross-section of less than approximately 10 microns maximum transverse dimension and to cause the sheath material to form a matrix extending substantially continuously in cross-section thereby to preclude separation of individual sheathed filaments. The sheathing material is completely removed while maintaining the filaments in bundled relationship to provide a tow of substantially bare separate filaments.

U.S. Pat. No. 3,375,569 to Eichinger et al teaches a method of making porous structures comprising the steps of winding a first row of wire on a winding support, the row having a large number of wire turns therein and having a predetermined pitch, winding subsequent rows of wire on the first row with each subsequent row having the same pitch as the first row so that each of the wire turns contacts substantially all of the immediately adjacent ones of the wire turns, bonding each of the turns to substantially all of its adjacent turns, and cutting sections from the turns generally transversely of the winding direction, the sections corresponding in thickness to the desired thickness of the porous structures.

U.S. Pat. No. 3,894,675 to Klebl et al discloses a copper clad steel wire being continuously produced by forming a copper sheet into a tube around the wire and welding the copper tube, at the edges, to produce a longitudinal seam. The diameter of the welded copper tube is reduced to the diameter of the wire, and the composite heated to a temperature of at least 850° C., at which temperature the cross sectional area of the composite wire is reduced by at least 10 percent to bond the copper to the steel wire.

U.S. Pat. No. 3,945,555 Schmidt discloses a manufacturing process for a solid or hollow shaft consisting of aluminum or titanium with beryllium reinforcing therein. Beryllium rods are either clad with aluminum or titanium or, in the alternative, holes are drilled in an aluminum or titanium block which beryllium material is thereafter inserted into the holes. The preform with a hard steel central mandrel around which the beryllium rods are positioned is placed within a steel can and heated to a predetermined temperature. Pressure is then uniformly applied to the outer circumference of the can to ensure uniform deformation of the beryllium reinforcement. The uniform exterior pressure on the outer surfaces of the beryllium rods and the interior pressure on these rods caused by the hard steel mandrel against the under surfaces of the rods as a result of a reduction process causes the beryllium rods to assume an arcuate ribbon configuration. For hollow shafting, the mandrel at the center of the preform may later be removed.

U.S. Pat. No. 4,109,870 to Wolber discloses a multiorifice structure and a method of making the multiorifice structure. The structure is made by fusing a plurality of parallel rods stacked in a regular geometric pattern. The interstices between the fused rods form a plurality of small orifices of a noncircular configuration which are ideally suited for atomizing a pressurized fluid. In the preferred embodiment, the multiorifice structure is a fuel atomizer for atomizing the fuel ejected from an automotive type fuel injection valve.

U.S. Pat. No. 4,156,500 to Yoshida et al teaches a method of producing a copper clad steel wire comprising the steps of preparing a 5 to 15 mm diameter steel rod and a 21 to 66.7 mm width copper tape; continuously supplying the steel rod and the copper tape separately and cleaning the surfaces thereof; forming the copper tape in tubular form such that the copper tape can cover the steel rod while supplying the steel rod and the copper tape in parallel, and welding the edges of the copper tape in a non-oxidizing atmosphere; sinking the tubular copper tape sufficiently for the copper tape to substantially come into contact with the steel rod to form a copper clad steel rod; cold-drawing the copper clad steel rod and/or hot working the clad rod at a temperature of 400° to 800° C. to reduce its cross-sectional area by more than 20%; and then annealing the copper clad steel rod at a temperature of 300° to 1050° C.

U.S. Pat. No. 4,166,564 to Wolber discloses a multiorifice structure and a method of making the multiorifice structure. The structure is made by fusing a plurality of parallel rods stacked in a regular geometric pattern. The interstices between the fused rods form a plurality of small orifices of a noncircular configuration which are ideally suited for atomizing a pressurized fluid. In the preferred embodiment, the multiorifice structure is a fuel atomizer for atomizing the fuel ejected from an automotive type fuel injection valve.

Although the aforementioned processes have provided high quality metallic fibers in the desired diameter range, the aforementioned processes still suffer from certain deficiencies. Firstly, the process of multiple claddings in one example incorporates the use of carbon steel cladding of stainless steel fibers. Unfortunately, the removal of carbon steel cladding material from stainless steel wire or fibers is a costly, time consuming and an environmentally unfriendly process. This is especially true when a three clad process is incorporated into the process of making fine metallic fibers.

Another disadvantage of the aforementioned process when making stainless steel fibers through the use of a carbon steel cladding is the involved chemical process for removing the carbon steel cladding from the stainless steel fibers. A further disadvantage of the prior art process is the amount of unusable byproducts from the carbon steel removed from the stainless steel to produce the fine metallic fibers.

Accordingly, it is an object of the present invention to provide an improved process for making fine metallic fibers which overcomes the disadvantages of the prior art and produces fine and ultra metallic fibers in an economic and efficient manner.

Another object of this invention is to provide an improved process for making fine and ultra fine metallic fibers wherein the cladding is used only partially through the drawing process.

Another object of this invention is to provide an improved process for making fine and ultra fine metallic fibers incorporating only a single continuous cladding process or a multiple continuous cladding process.

Another object of this invention is to provide an improved process for making fine and ultra metallic fibers wherein the cladding of the formed type is mechanically removed without the need for a chemical leaching process.

Another object of this invention is to provide an improved process for making fine and ultra fine metallic fibers incorporating a metallic copper coating and a carbon steel cladding wherein the copper coating inhibits the diffusion of undesirable impurities from the carbon steel cladding into the metallic fibers.

Another object of this invention is to provide an improved process for making fine and ultra fine metallic fibers wherein the metallic fibers can be produced with a simple chemical leaching process or electrolysis process whereby the material removed is totally reusable within the process.

Another object of this invention is to provide an improved process for making fine and ultra fine metallic fibers whereby the leaching or electrolysis process is simple and efficient, fast and economical to operate.

Another object of this invention is to provide an improved process for making fine and ultra fine metallic fibers whereby fibers in the nanometer range can be obtained in commercial quantities.

Another object of this invention is to provide an improved process for making fine and a fine metallic fibers that provides high quality metallic fibers of low impurities at an economical manufacturing cost.

Another object of this invention is to provide an improved process for making fine and ultra fine metallic fibers that incorporates a process that produces only products that may be reusable byproducts or environmentally safe disposable byproducts.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an apparatus and a process for making fine metallic fibers comprising coating a plurality of metallic wires with a coating material. A continuous tube is formed about the plurality of metallic wires for providing a cladding. The cladding is drawn for reducing the outer diameter thereof and for reducing the cross-section of each of the plurality of metallic wires within the cladding and for diffusion welding the coating material within the cladding to form a substantially unitary coating material with the plurality of metallic wires contained therein. The tube is mechanically removed to provide a remainder comprising the diffusion welded coating material with the plurality of metallic wires contained therein. The remainder is drawn for reducing the diameter thereof and for reducing the corresponding cross-section of each of the plurality of metallic wires contained therein to transform the plurality of metallic wires into a plurality of fine metallic fibers. The diffusion welded coating material is removed from the remainder for providing the plurality of fine metallic fibers.

The invention is also incorporated into the process for making ultra fine metallic fibers comprising coating a plurality of metallic wires with a coating material. A continuous tube is formed about the plurality of metallic wires for providing a first cladding. The first cladding is drawn for reducing the outer diameter thereof and for reducing the cross-section of each of the plurality of metallic wires within the first cladding and for diffusion welding the coating material within the first cladding to form a substantially unitary coating material with the plurality of metallic wires contained therein. The tube is mechanically removed to provide a first remainder comprising the diffusion welded coating material with the plurality of metallic wires contained therein. The first remainder is drawn for reducing the diameter thereof and for reducing the corresponding cross-section of each of the plurality of metallic wires contained therein to transform the plurality of metallic wires into a plurality of fine metallic fibers. A plurality of the drawn first remainders is assembled and a continuous tube is formed about the assembly of drawn first remainders for providing a second cladding. The second cladding is drawn for reducing the outer diameter thereof and for reducing the cross-section of each of the plurality of fine metallic fibers within the second cladding and for diffusion welding the coating material within the second cladding to form a substantially unitary coating material with the plurality of fine metallic fibers contained therein. The tube is mechanically removed to provide a second remainder comprising the diffusion welded coating material with the plurality of fine metallic fibers contained therein. The second remainder is drawn for reducing the diameter thereof and for reducing the corresponding cross-section of each of the plurality of fine metallic fibers contained therein to transform the plurality of fine metallic fibers into a plurality of ultra fine metallic fibers. The diffusion welded coating material is removed from the second remainder for providing the plurality of ultra fine metallic fibers.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated that the conception and the specific embodiments disclosed may be readily utilized as a basis for modifying or designing other structures for carrying out the same purposes of the present invention. It also should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
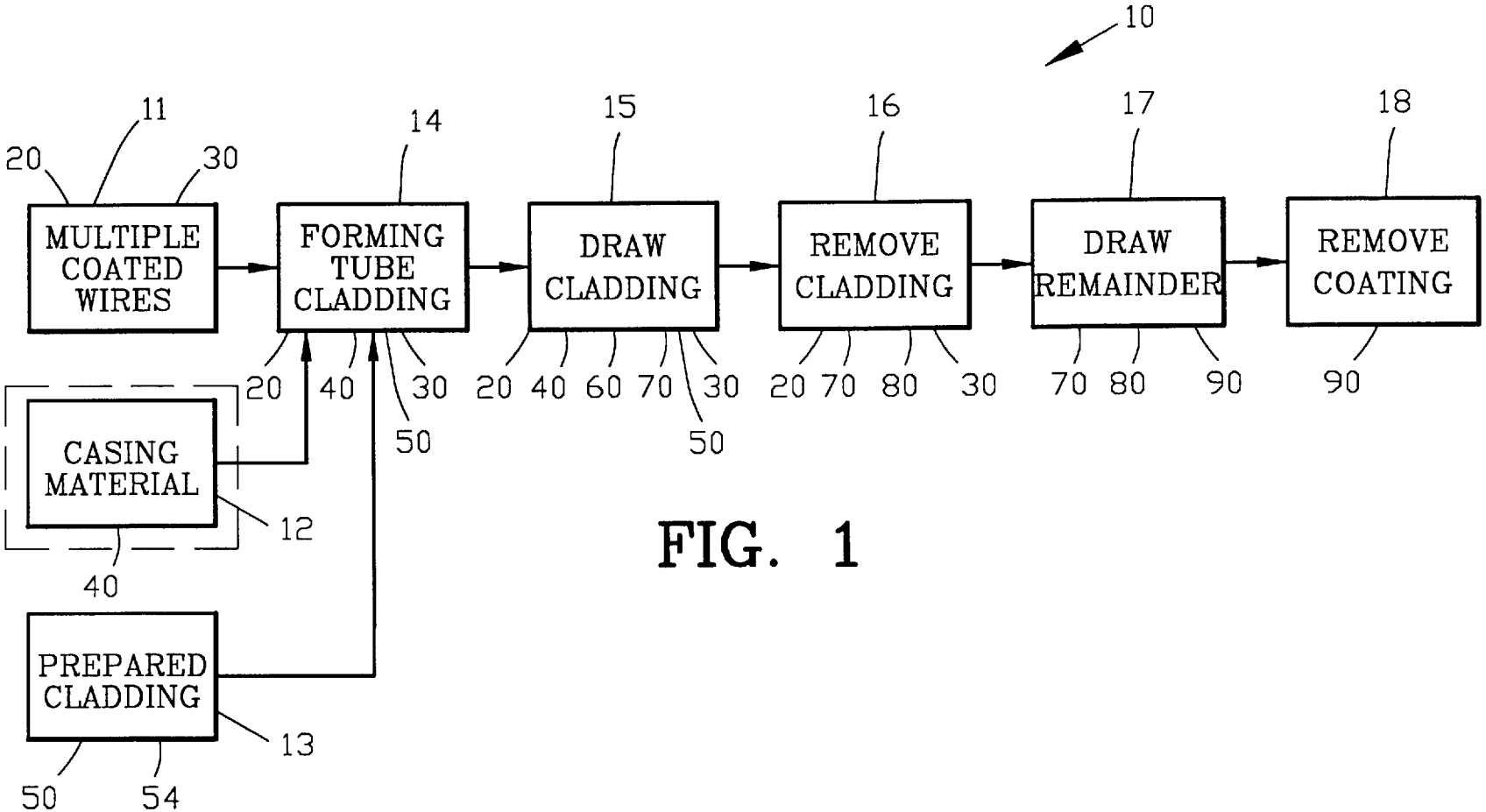
FIG. 1 is a block diagram illustrating a first improved process of forming fine metallic fibers through a new cladding and drawing process of the present invention.

FIG. 1 is a block diagram illustrating an improved process 10 for making fine metallic fibers. The improved process 10 of FIG. 1 comprises the process step 11 of providing multiple coated metallic wires 20 with each of the metallic wires 20 having a coating material 30.

Figure 2:
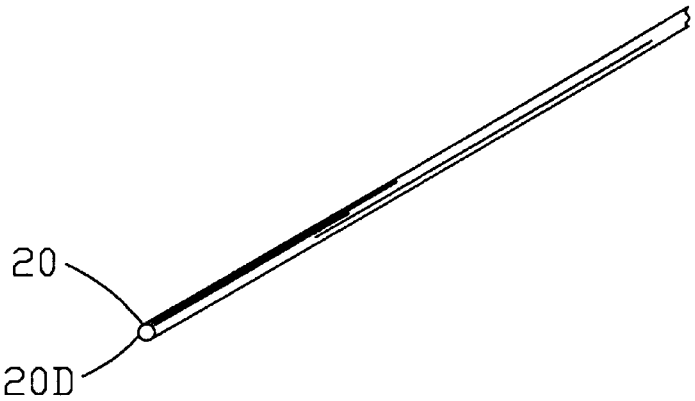
FIG. 2 is an isometric view of a metallic wire referred to in FIG. 1.
Figure 2A:
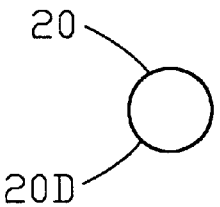
FIG. 2A is an enlarged end view of FIG. 2.

FIG. 2 is an isometric view of the metallic wire 20 referred to in FIG. 1 with FIG. 2A being an enlarged end view of FIG. 2. In this example, the metallic wire 20 is a stainless steel wire having a diameter 20D but it should be understood that various types of metallic wires 20 may be used in the improved process 10.

Figure 3:
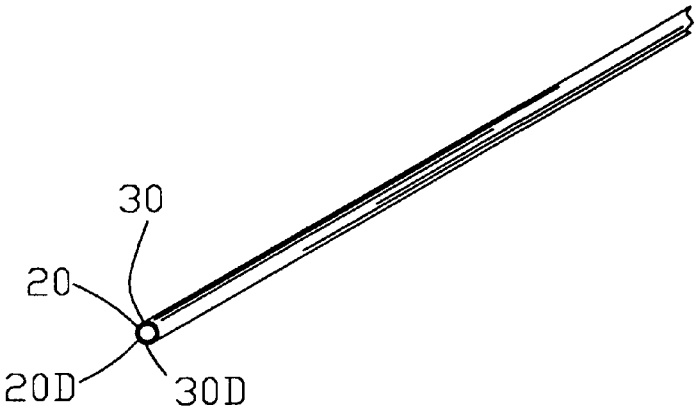
FIG. 3 is an isometric view of the wire of FIG. 2 with a coating material thereon.
Figure 3A:
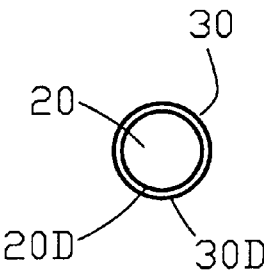
FIG. 3A is an enlarged end view of FIG. 3.

FIG. 3 is an isometric view of the metallic wire 20 of FIG. 2 with the coating material 30 thereon. FIG. 3A is an enlarged end view of FIG. 3. In this example, the coating material 30 is a copper material but it should be understood that various types of coating materials 30 may be used in the improved process 10.

The process of applying the coating material 30 to the metallic wire 20 may be accomplished in various ways. One preferred process of applying the coating material 30 to the metallic wire 20 is an electroplating process. The coating material 30 defines a coating diameter 30D. Preferably, the coating material 30 represents approximately five percent (5%) by weight of the combined weight of the metallic wire 20 and the coating material 30.

A plurality of the metallic wires 20 with the coating material 30 are formed into an assembly of metallic wires 20. Preferably, 150 to 1200 metallic wires 20 with the coating material 30 are formed into the assembly 34.

FIG. 1 illustrates an optional process step 12 of encasing the assembly 34 of metallic wires 20 with a casing material 40. Preferably, the casing material 40 is the same material as the coating material 30.

Figure 4:
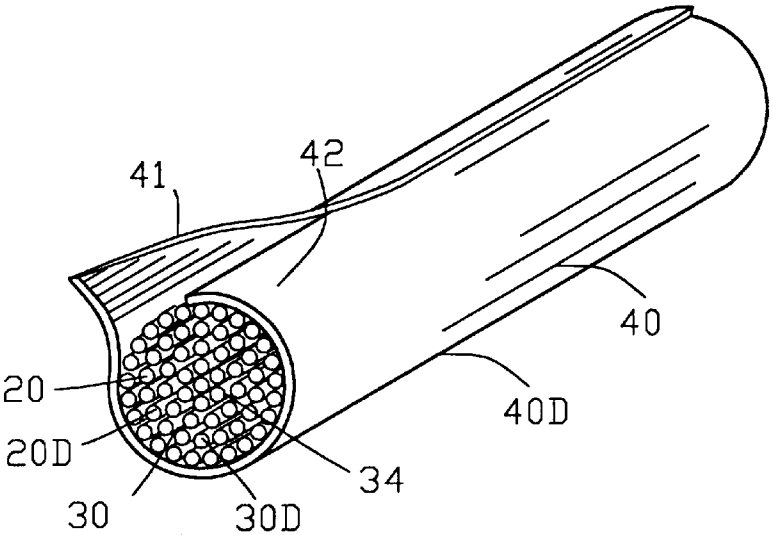
FIG. 4 is an isometric view of an initial step of a first optional process of encasing an assembly of a plurality of wires of FIG. 3 within a casing.
Figure 4A:
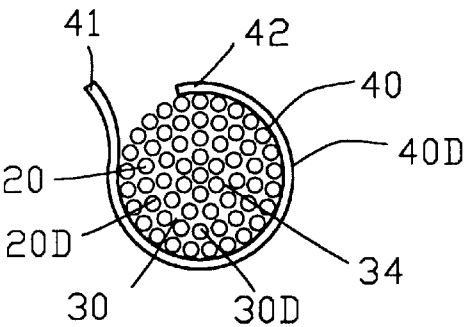
FIG. 4A is an end view of FIG. 4.

FIG. 4 illustrates an initial step in a first example of the optional process step 12 of encasing the assembly 34 of metallic wires 20 with the casing material 40. FIG. 4A is an end view of FIG. 4. The step of encasing the assembly 34 within the casing material 40 includes bending a first and a second edge 41 and 42 of a longitudinally extending casing material 40 to form the casing 44.

Figure 5:
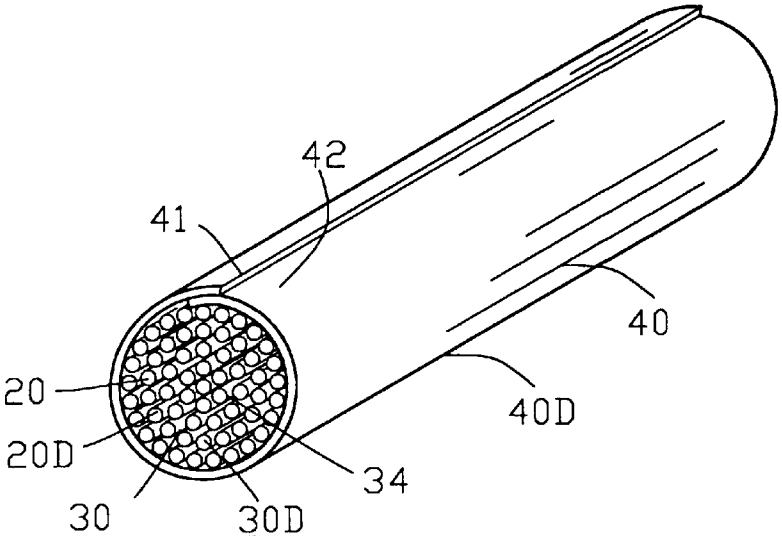
FIG. 5 is an isometric view of the completed step of the first optional process of encasing the assembly of the plurality of wires of FIG. 3 within the casing.
Figure 5A:
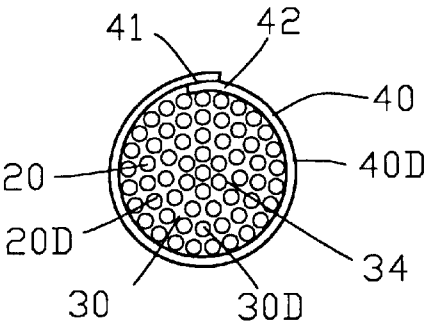
FIG. 5A is an end view of FIG. 5.

FIG. 5 illustrates the completed process of encasing the assembly 34 of the plurality of the wires 20 within the casing material 40. FIG. 5A is an end view of FIG. 5. The casing material 40 is bent about the assembly 34 of the plurality of the wires 20 with the first edge 41 of the casing material 40 overlapping the second edge 42 of the casing material 42. The assembly 34 of the plurality of the wires 20 are encased within the casing material 40 for providing the casing 44 having a diameter 44D.

Figure 6:
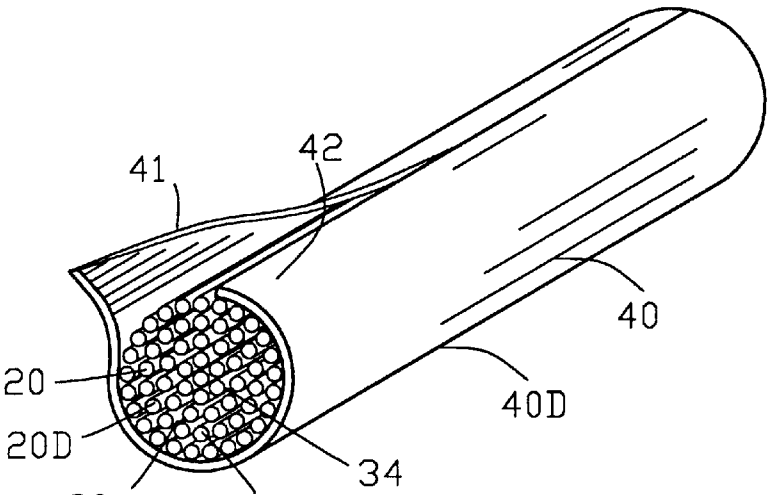
FIG. 6 is an isometric view of an initial step of a second optional process of encasing an assembly of a plurality of wires of FIG. 3 within a casing.
Figure 6A:
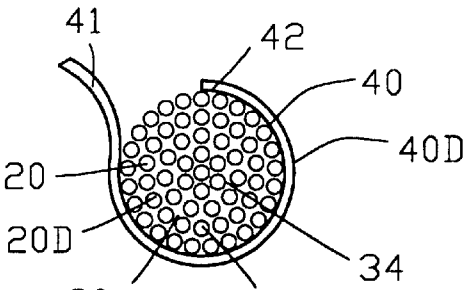
FIG. 6A is an end view of FIG. 6.

FIG. 6 illustrates an initial step in a second example of the optional process step 12 of encasing the assembly 34 of metallic wires 20 with the casing material 40. FIG. 6A is an end view of FIG. 6. The step of encasing the assembly 34 within the casing material 40 includes bending a first and a second edge 41 and 42 of a longitudinally extending casing material 40 to form the casing 44.

Figure 7:
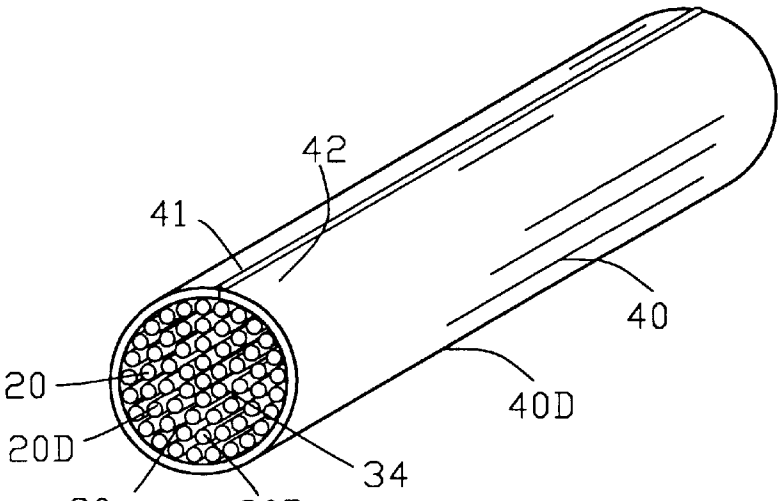
FIG. 7 is an isometric view of the completed step of the second optional process of encasing the assembly of the plurality of wires of FIG. 3 within the casing.
Figure 7A:
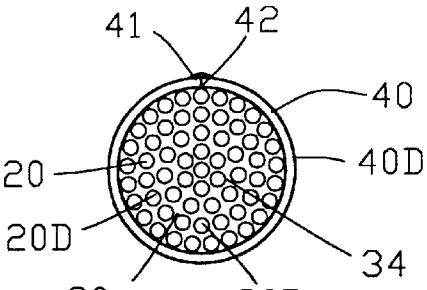
FIG. 7A is an end view of FIG. 7.

FIG. 7 illustrates the completed process of encasing the assembly 34 of the plurality of the wires 20 within the casing material 40. FIG. 7A is an end view of FIG. 7. The casing material 40 is bent about the assembly 34 of the plurality of the wires 20 with the first edge 41 of the casing material 40 abutting the second edge 42 of the casing material 42. Preferably, the first edge 41 of the casing material 40 is welded to the second edge 42 of the casing material 40 by a weld 46. The assembly 34 of the plurality of the wires 20 are encased within the casing material 40 for providing the casing 44 having a diameter 44D.

FIG. 1 illustrates the process step 13 of preparing a cladding material 50. Preferably, the cladding material 50 is a longitudinally extending cladding material 50 having a first and a second edge 51 and 52. A surface of the cladding material 50 may be treated with a release material 54 to inhibit chemical interaction between the cladding material 50 and the plurality of metallic wires 20 or the casing material 40. The release material 54 may be any suitable material to inhibit chemical interaction between the cladding material 50 and the plurality of metallic wires 20 or the coating material 30 or the casing material 40.

Preferably, the cladding material 50 is made of a carbon steel material. The release material 42 may be titanium dioxide $TiO_2$, sodium silicate, aluminum oxide, talc or any other suitable material to inhibit chemical interaction between the cladding material 50 and the coating material 30 or the casing material 40. The release material 54 may be suspended within a liquid for enabling the release material 54 to be painted onto the cladding material 50. In the alternative, the release material 54 may be applied by flame spraying or a plasma gun or any other suitable means.

FIG. 1 illustrates the process step 14 of forming a continuous tube 55 of the cladding material 50 about the plurality of metallic wires 20 or the casing material 40. In this example, the cladding material 50 is a carbon steel material with the plurality of metallic wires 20 being made of a stainless steel material. The coating material 30 and the casing material 40 are preferably a copper material.

Figure 8:
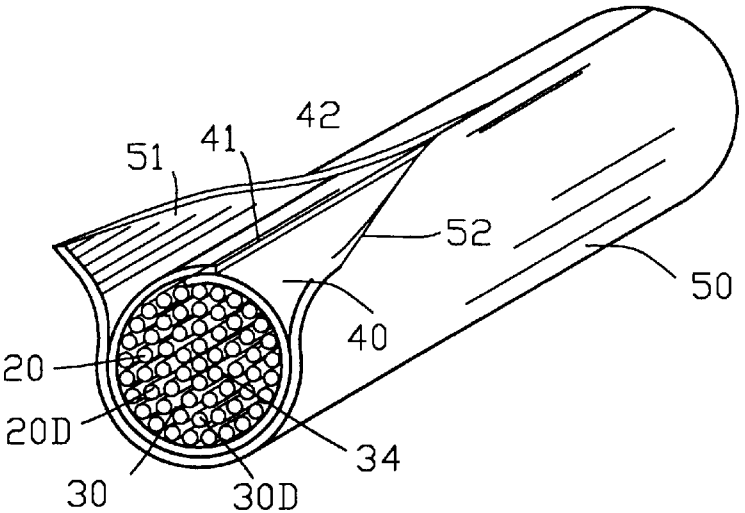
FIG. 8 is an isometric view of an initial process of forming a tube about the casing of FIG. 5 with a cladding material.
Figure 8A:
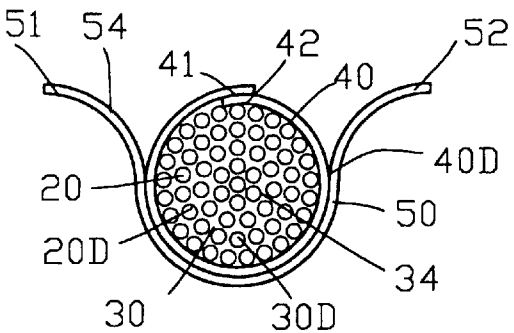
FIG. 8A is an end view of FIG. 8.

FIG. 8 is an isometric view illustrating an initial process of forming the continuous tube 55 of the cladding material 50 about the plurality of metallic wires 20 and the casing material 40. FIG. 8A is an end view of FIG. 8. The step 14 of forming the tube 55 from the cladding material 50 includes bending the first and second edges 51 and 52 of the longitudinally extending sheet of the cladding material 50 to form a cladding 60 for enclosing the casing material 40. The cladding 60 defines an outer diameter 60D.

Figure 9:
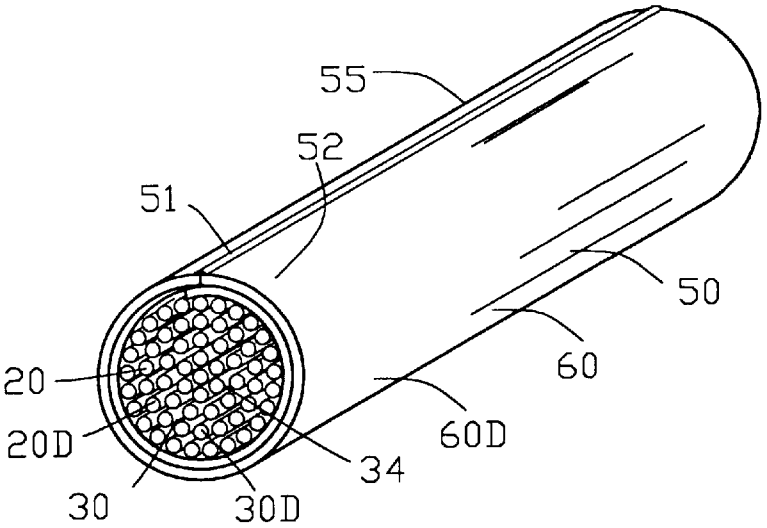
FIG. 9 is an isometric view of the completed process of forming the tube about the casing of FIG. 5 with the cladding material.
Figure 9A:
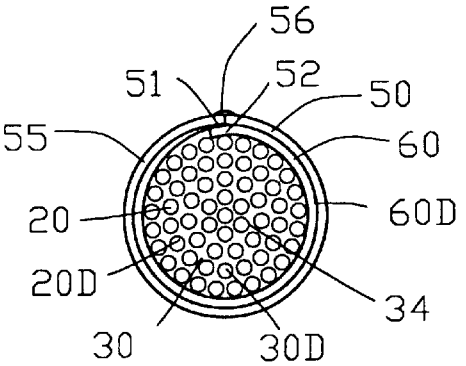
FIG. 9A is an end view of FIG. 9.

FIG. 9 is an isometric view of the completed process of forming the continuous tube 55 of the cladding material 50. FIG. 9A is an end view of FIG. 9. The longitudinally extending sheet of the cladding material 50 is bent with the first edge 51 of the cladding material 50 abutting the second edge 52 of the cladding material 50. The first edge 51 of the cladding material 50 is welded to the second edge 52 of the cladding material 50 by a weld 56.

When the optional casing material 40 is used in the process, the casing material 40 acts as a heat sink to facilitate the welding of the first edge 51 to the second edge 52 of the cladding material 50. Furthermore, the casing material 40 acts as a heat sink to protect the assembly 34 of the plurality of coated wires 20 within the casing material 40 from the heat of the welding process.

FIG. 1 illustrates the process step 15 of drawing the cladding 60. The process step 15 of drawing the cladding 60 provides four effects. Firstly, the process step 15 reduces an outer diameter 60D of the cladding 60. Secondly, the process step 15 reduces the corresponding outer diameter 20D of each of the plurality of metallic wires 20 and the corresponding outer diameter 30D of each of the coating materials 30. Thirdly, the process step 15 causes the coating materials 30 on each of metallic wires 20 to diffusion weld with the coating materials 30 on adjacent metallic wires 20. Fourthly, the process step 15 causes the casing material 40 to diffusion weld with the coating material 30 on the plurality of metallic wires 20.

Figure 10:
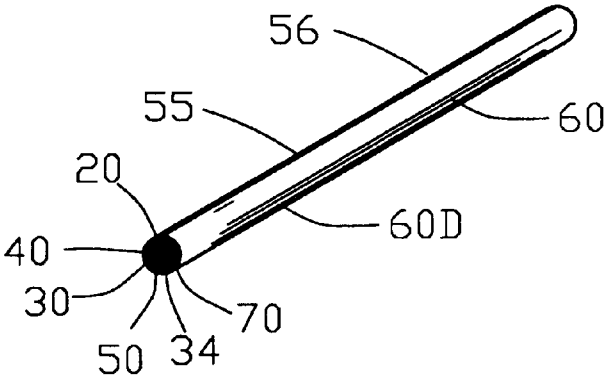
FIG. 10 is an isometric view of the cladding of FIG. 9 after a first drawing process.
Figure 10A:
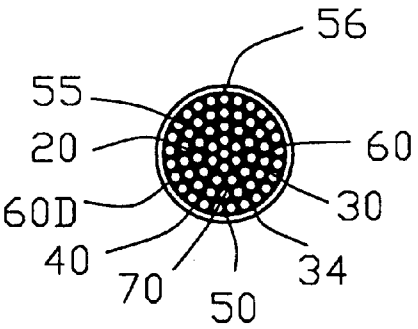
FIG. 10A is an enlarged end view of FIG. 10.

FIG. 10 is an isometric view of the cladding 60 of FIG. 9 after the first drawing process. FIG. 10A is an enlarged end view of FIG. 10. The drawing of the cladding 60 causes the coating material 30 on each of the plurality of metallic wires 20 to diffusion weld with the coating materials 30 on adjacent plurality of metallic wires 20 and to diffusion weld with the casing material 40. The diffusion welding of the coating material 30 and the casing material 40 forms a unitary material 70. After the diffusion welding of the coating material 30 and the casing material 40, the coating material 30 and the casing material 40 are formed into a substantially unitary material 70 extending throughout the interior of the cladding 60. The plurality of metallic wires 20 are contained within the unitary material 70 extending throughout the interior of the cladding 60. Preferably, the coating material 30 and the casing material 40 is a copper material and is diffusion welded within the cladding 60 to form a substantially unitary copper material 70 with the plurality of metallic wires 20 contained therein.

The release material 54 is deposited on the cladding material 50 of the formed tube 55 in a quantity sufficient to inhibit the chemical interaction or bonding between the tube 55 and a plurality of metallic wires 20 and the coating materials 30 and the casing material 40 within the tube 55. However, the release material 54 is deposited on the tube 55 in a quantity insufficient to inhibit the diffusion welding of the coating materials 30 on adjacent metallic wires 20 and the casing material 40.

FIG. 1 illustrates the process step 16 of removing the tube 55. In the preferred form of the process, the step 16 of removing the tube 55 comprises mechanically removing the tube 55.

Figure 11:
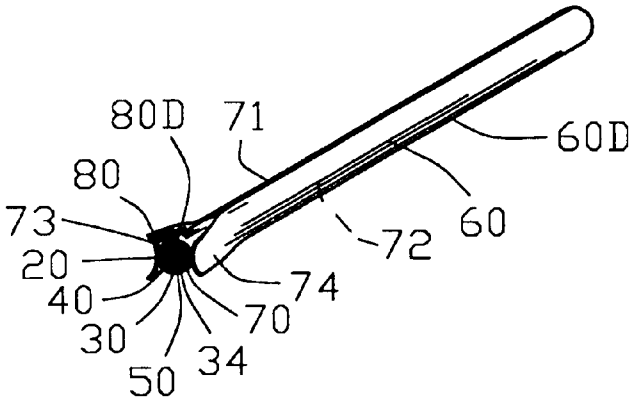
FIG. 11 is an isometric view illustrating the mechanical removal of the tube after the first drawing process of FIG. 10.
Figure 11A:
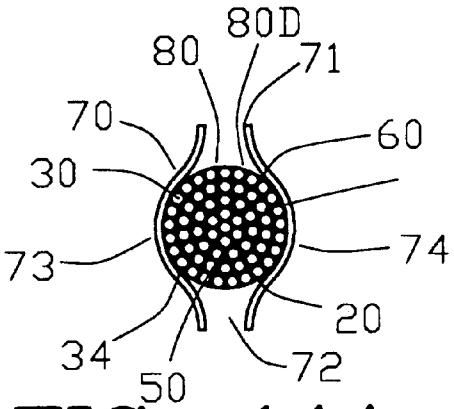
FIG. 11A is an enlarged end view of FIG. 11.

FIG. 11 is an isometric view illustrating the mechanical removal of the tube 55 with FIG. 11A being an enlarged end view of FIG. 11. In one example of this process step 16, the tube 55 is scored or cut at 71 and 72 by mechanical scorers or cutters (not shown). The scores or cuts at 71 and 72 form tube portions 73 and 74 that are mechanically pulled apart to peel the tube 55 off of a remainder 80. The remainder 80 comprises the substantially unitary coating material 70 with the plurality of metallic wires 20 contained therein. The remainder 80 defines an outer diameter 80D.

FIG. 1 illustrates the process step 17 of drawing the remainder 80 for reducing the outer diameter 80D thereof and for reducing the corresponding outer diameter 20D of the plurality of metallic wires 20 contained therein.

Figure 12:
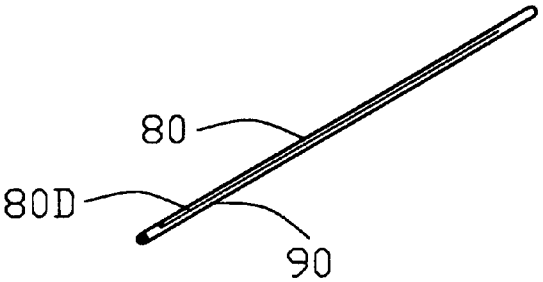
FIG. 12 is an isometric view of the casing of FIG. 11 after the second drawing process.
Figure 12A:
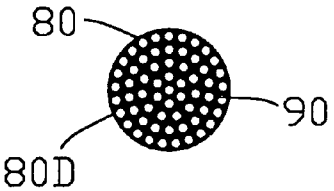
FIG. 12A is an enlarged end view of FIG. 12.

FIG. 12 is an isometric view of the plurality of wires 20 of FIG. 11 reduced into a plurality of fine metallic fibers 90 by the process step 17 of drawing the remainder 80. FIG. 12A is an enlarged end view of FIG. 12. The substantially unitary material 70 provides mechanical strength for the plurality of metallic wires 20 contained therein for enabling the remainder 80 to be drawn without the cladding 60. The substantially unitary coating material 30 and casing material 40 enables the remainder 80 to be drawn for reducing the outer diameter 80D thereof and for providing the plurality of fine metallic fibers 90.

Figure 13:
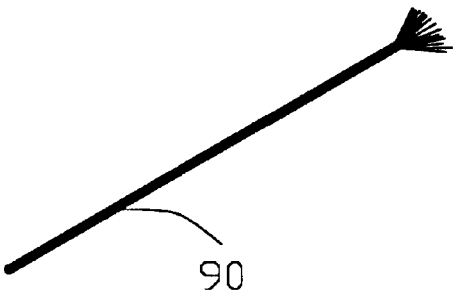
FIG. 13 is an isometric view of the plurality of the fine metallic fibers of FIG. 12 after removal of the coating material.
Figure 13A:
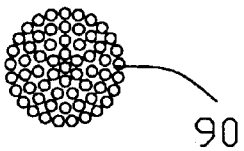
FIG. 13A is an enlarged end view of FIG. 13.

FIG. 13 is an isometric view of the plurality of the fine metallic fibers 90 of FIG. 12 after the process step 18 of removing the unitary material 70. FIG. 13A is an enlarged end view of FIG. 13. Preferably, the unitary material 70 is removed by an acid leaching process for dissolving the unitary copper material 70 to provide a plurality of stainless steel fibers 90.

One example of the process step 18 includes an acid leaching process. The remainder 80 comprising the substantially unitary copper material 30 with the plurality of stainless steel wires 20 is immersed into a solution of 8% to 15% $H_2SO_4$ and 0.1% to 1.0% $H_2O_2$ for dissolving the unitary copper material 70 without dissolving the stainless steel fibers 90. The 0.1% to 1.0% $H_2O_2$ functions as an oxidizing agent to inhibit leaching of stainless steel fibers 90 by the $H_2SO_4$. Preferably, the 0.5% to 3.0% $H_2O_2$ is stabilized from decaying in the presence of copper such as PC circuit board grade $H_2O_2$. It should be appreciated that other oxidizing agents may be used with the present process such as sodium stanate or sodium benzoate or the like.

The above acid leaching process 16 is governed by the reaction illustrated in equation $$Cu+H_2O_2+H_2SO_4 \rightarrow CuSO_4+2H_2O$$

The initial concentration of the $H_2SO_4$ is 11.0% at a concentration of 20.0 grams per liter of Cu+2 as $CuSO_4$ at a temperature of 80° F. to 120° F. The concentration is maintained between 8.0% to 11.0% $H_2SO_4$ and 20.0 to 70.0 grams per liter of $Cu^{+2}$ as $CuSO_4$.

The dissolving of the unitary copper material 70 in the presence of the $H_2O_2$ dissolves the unitary copper material 70 without dissolving the stainless steel fibers 90. After the unitary copper material 70 is dissolved, the stainless steel fibers 90 are passed to a rinsing process.

The removal process 18 includes rinsing the stainless steel fibers 90 in a rinse solution comprising $H_2O$ having a pH of 2.0 to 3.0 with the pH being adjusted with $H_2SO_4$. Maintaining the pH of the rinsing solution between a pH of 2.0 to 3.0 inhibits the formation of $Fe[OH]_2$. After rinsing the stainless steel fibers 90, the stainless steel fibers 90 may be used as cut stainless steel fibers 90 or as stainless steel fiber tow.

Figure 14:
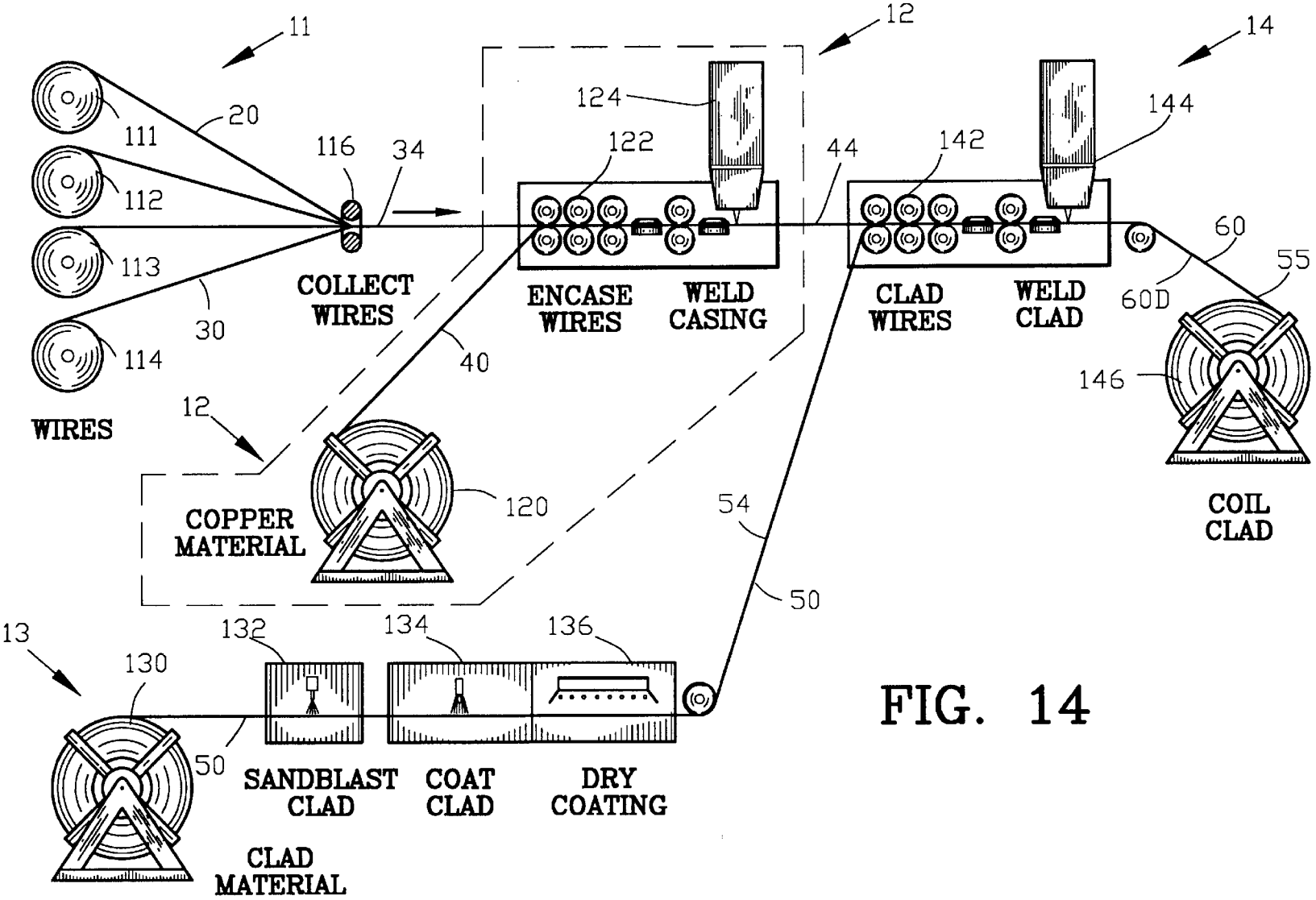
FIG. 14 is a diagram illustrating a first portion of an apparatus for performing the first improved process of forming fine metallic fibers shown in FIG. 1.
Figure 15:
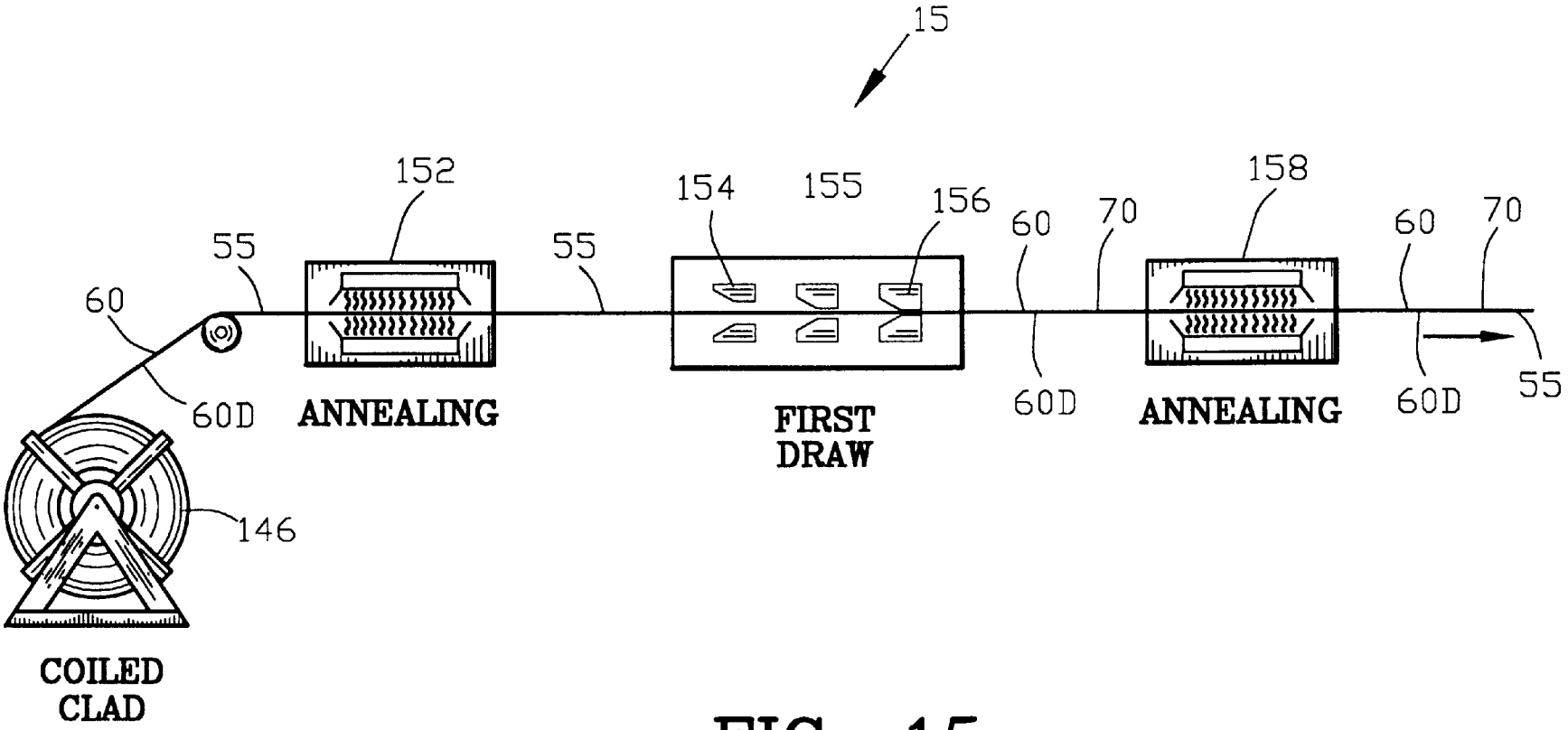
FIG. 15 is a diagram illustrating a second portion of the apparatus of FIG. 14.
Figure 16:
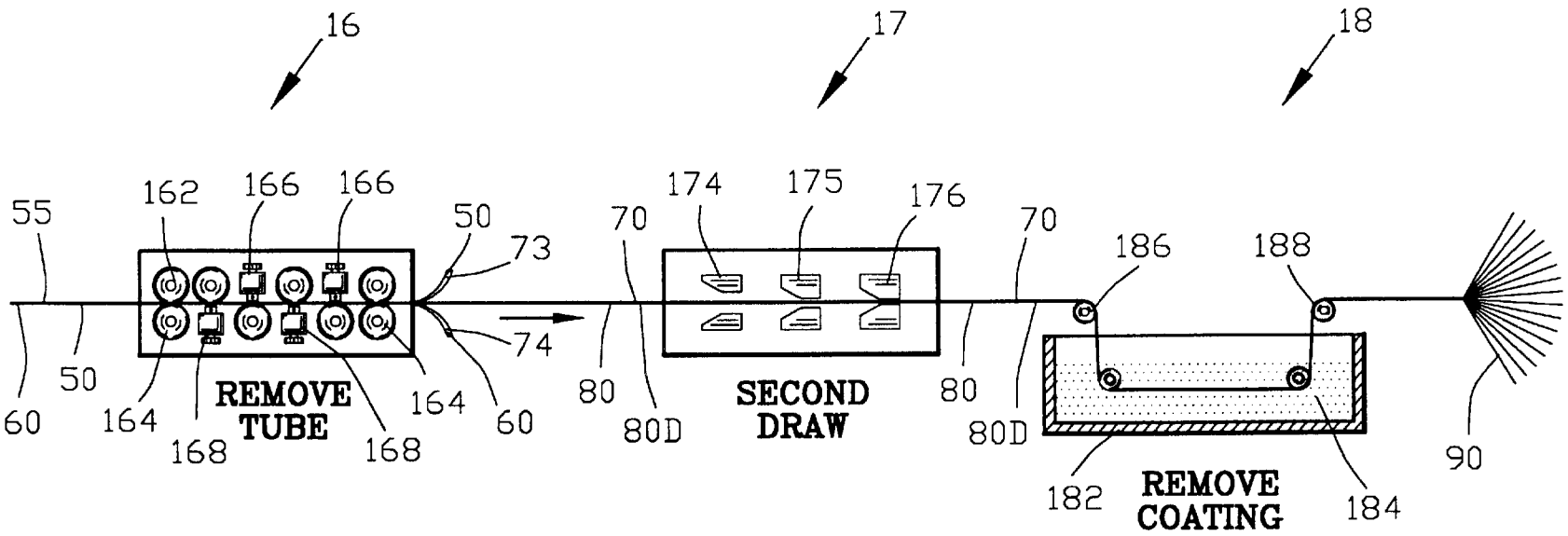
FIG. 16 is a diagram illustrating a third portion of the apparatus of FIG. 14.

FIGS. 14–16 are diagrams illustrating a first through third portions of an apparatus 100 for performing the first improved process 10 of forming fine metallic fibers 90 shown in FIG. 1. The process steps 11–18 are displayed adjacent the respective region of the apparatus 100 accomplishing the respective process step.

FIG. 14 illustrates a plurality of spools 111–114 containing the plurality of metallic wires 20 with the coating material 30. Although FIG. 14 only shows four spools, it should be understood that between 150 to 1200 spools are typically provided in the apparatus 100. The plurality of metallic wires 20 with the coating material 30 are collected by a collar 116 to form the assembly 34 of the plurality of metallic wires 20.

A spool 120 contains the casing material 40 for encasing the assembly 34 of metallic wires 20. The casing material 40 is drawn from the spool 120 by a series of rollers 122. The series of rollers 122 bend the casing material 40 about the assembly 34 of the plurality of the wires 20 with the first edge 41 of the casing material 40 overlapping the second edge 42 of the casing material 42. In the alternative, the series of rollers 122 bend the casing material 40 about the assembly 34 of the plurality of the wires 20 with the first edge 41 of the casing material 40 abutting the second edge 42 of the casing material 42. A welder 124 welds the abutting first and second edges 41 and 42 of the casing material 40.

A spool 130 contains the cladding material 50 for cladding the assembly 34 of metallic wires 20 and the casing material 40. The cladding material 50 is a longitudinally extending cladding material 50 having a first and a second edge 51 and 52. The surface of the cladding material 50 is cleaned by suitable means such as a sandblaster 132. Although the cleaning process has been shown as a sandblaster 132, it should be understood that the surface of the cladding material 50 may be cleaned by other suitable means as should be understood by those skilled in the art.

The surface of the cladding material 50 is treated with a release material 54 to inhibit chemical interaction between the cladding material 50 and the plurality of metallic wires 20 or the casing material 40. In this example, the release material 54 is applied by flame spraying 134 aluminum to the surface of the cladding material 50. The aluminum forms alumina or aluminum oxide that is bonded to the surface of the cladding material 50. In the alternative, the release material 54 may be applied by a plasma gun, painting or any other suitable means. A dryer 136 drys the coated release material 54 on the surface of the cladding material 50.

A series of rollers 142 bends the cladding material 50 to form the continuous tube 55 about the plurality of metallic wires 20 or the casing material 40. In this example, the cladding material 50 is a carbon steel material with the plurality of metallic wires 20 being made of a stainless steel material. The coating material 30 and the casing material 40 are preferably a copper material. The series of rollers 142 bends the first and second edges 51 and 52 of the longitudinally extending sheet of the cladding material 50 to form a cladding 60 for enclosing the casing material 40. The first edge 51 of the cladding material 50 abuts the second edge 52 of the cladding material 50. A welder 144 welds the first edge 51 of the cladding material 50 to the second edge 52 of the cladding material 50 to form the tube 55. The completed cladding 60 is rolled on a spool 146.

FIG. 15 illustrates the second portion of the apparatus 100 shown in FIG. 1. The cladding 60 unrolled from the spool 146. The cladding 60 is pulled through an annealing oven 152 for annealing the cladding 60.

The cladding 60 is drawn through a series of dies 154–156 for reducing an outer diameter 60D of the cladding 60. In addition, the drawing of the cladding 60 causes the coating materials 30 and the optional casing material 40 to diffusion weld with the coating materials 30 on adjacent metallic wires 20 to form the unitary material 70.

The release material 54 deposited on the cladding material 50 inhibits the chemical interaction or bonding between the tube 55 and a plurality of metallic wires 20 and the coating materials 30 and the casing material 40 within the tube 55.

FIG. 16 illustrates the third portion of the apparatus 100 shown in FIG. 1. The tube 55 is passed through a series of upper and lower rollers 162 and 164 for positioning the tube 55 between a series of upper and lower cutting blades 166 and 168. The upper and lower cutting blades 166 and 168 make the scores or cuts 71 and 72 shown in FIG. 11 and 11A in the cladding 60. The tube portions 73 and 74 are mechanically pulled apart to peel the tube 55 off of a remainder 80. The remainder 80 comprises the substantially unitary coating material 70 with the plurality of metallic wires 20 contained therein.

The remainder 80 is drawn through a series of dies 174–176 for reducing an outer diameter 80D of the remainder 80 and for reducing the corresponding outer diameter 20D of the plurality of metallic wires 20 contained therein. The remainder 80 is drawn for reducing the outer diameter 80D of the remainder 80 and for transforming the plurality of metallic wires 20 into a plurality of fine metallic fibers 90.

The plurality of the fine metallic fibers 90 are directed into a reservoir 182 containing a chemical agent 184 by rollers 186 and 188. The chemical agent 184 removes the unitary material 70. Preferably, the chemical agent 184 is an acid for dissolving the unitary material 70 to provide a plurality of metallic fibers 90.

Figure 17:
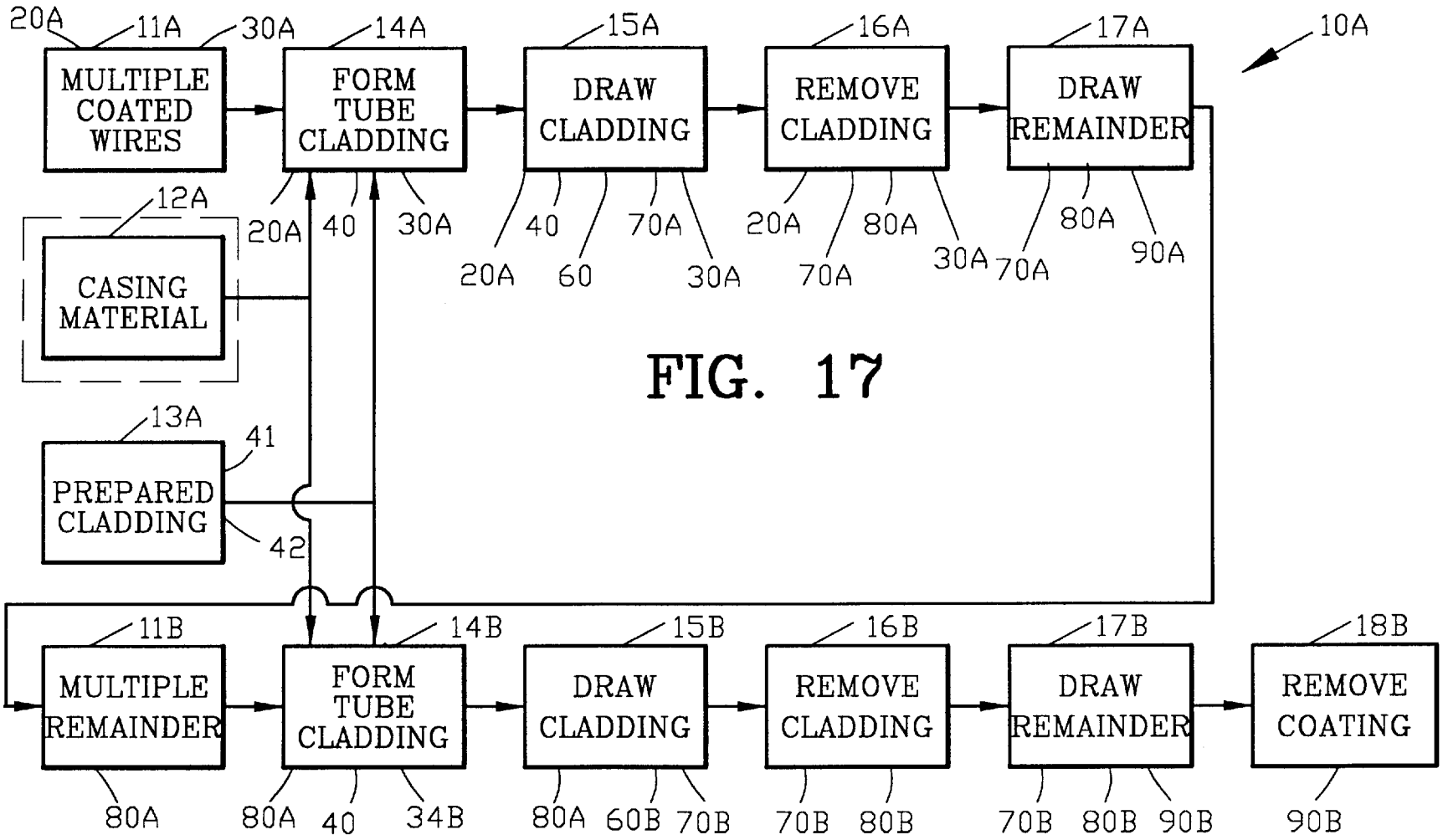
FIG. 17 is a block diagram illustrating a second improved process of forming ultra fine metallic fibers through a new cladding and drawing process of the present invention.
Figure 19:
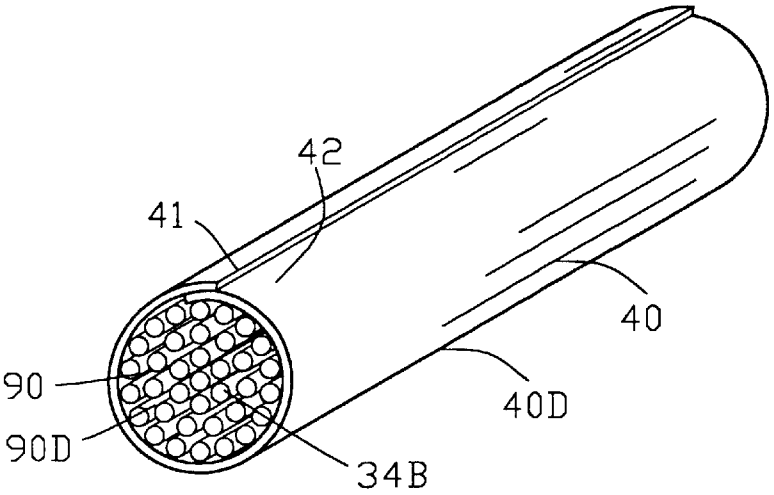
FIG. 19 is an isometric view of the completed step of the first optional process of encasing the assembly of the plurality remainders of FIG. 12 within the second casing.
Figure 19A:
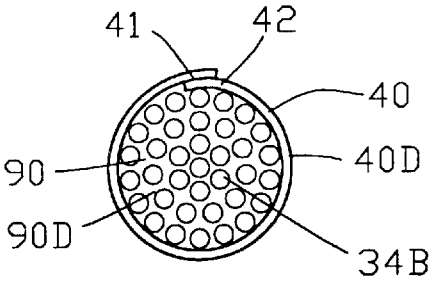
FIG. 19A is an end view of FIG. 19.
Figure 18:
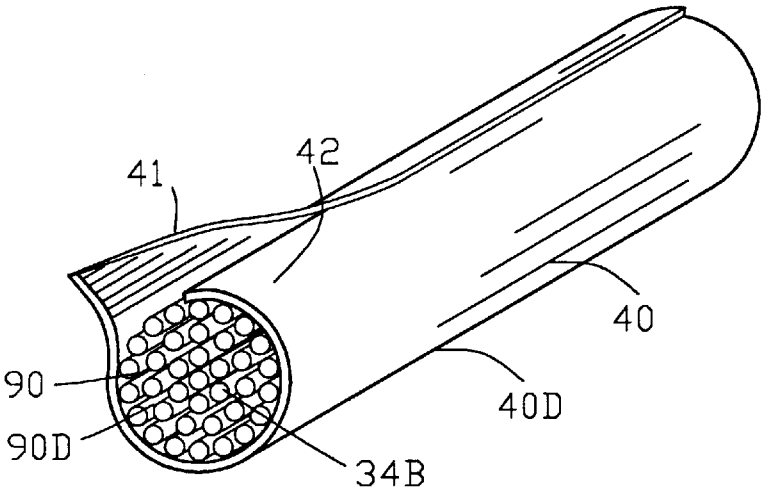
FIG. 18 is an isometric view of an initial step of a first optional process of encasing an assembly of a plurality of the remainders of FIG. 12 within a second casing.
Figure 18A:
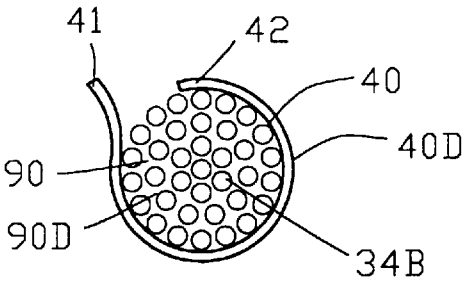
FIG. 18A is an end view of FIG. 18.
Figure 21:
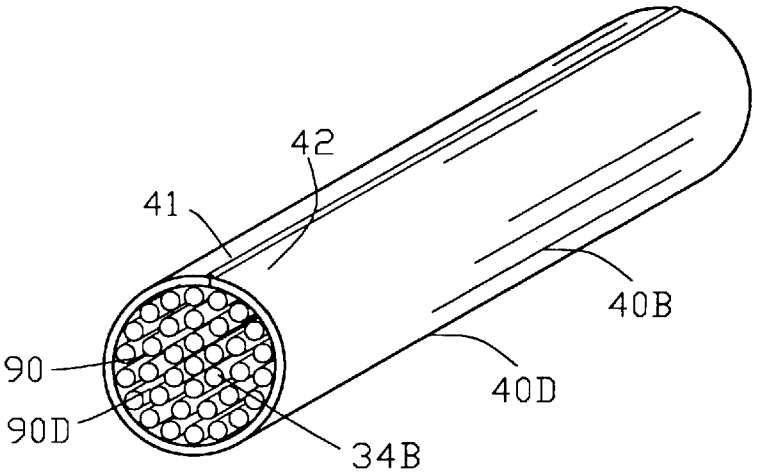
FIG. 21 is an isometric view of the completed step of the second optional process of encasing the assembly of the plurality of remainders of FIG. 12 within the second casing.
Figure 21A:
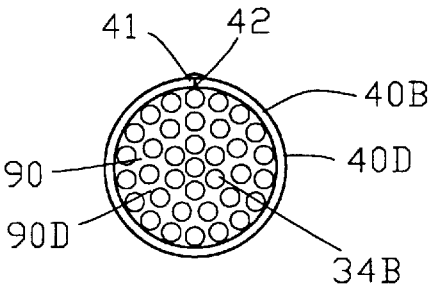
FIG. 21A is an end view of FIG. 21.
Figure 20:
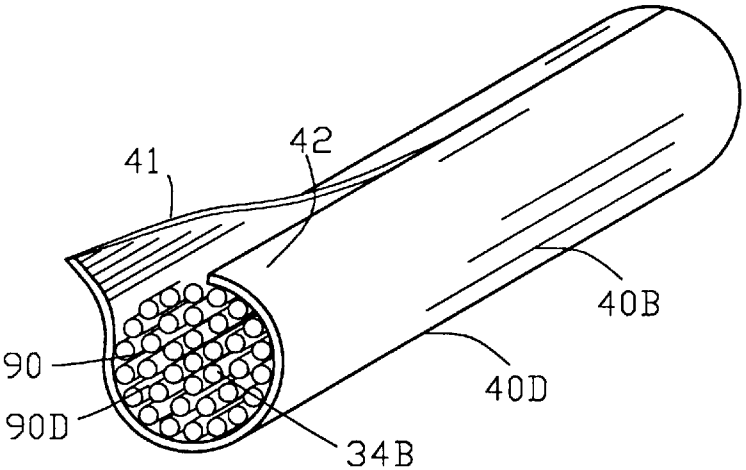
FIG. 20 is an isometric view of an initial step of a second optional process of encasing an assembly of the plurality of remainders of FIG. 12 within a second casing.
Figure 20A:
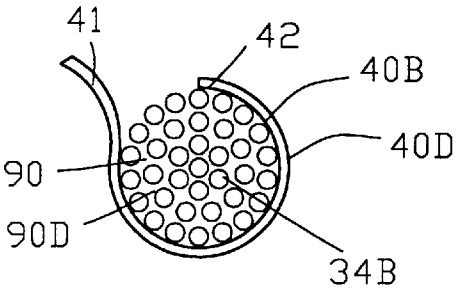
FIG. 20A is an end view of FIG. 20.
Figure 23:
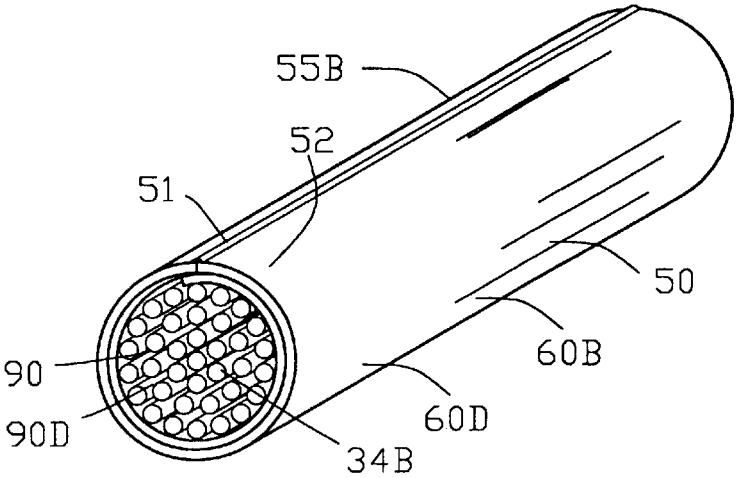
FIG. 23 is an isometric view of the completed process of forming the second tube about the second casing of FIG. 19 with the second cladding material.
Figure 23A:
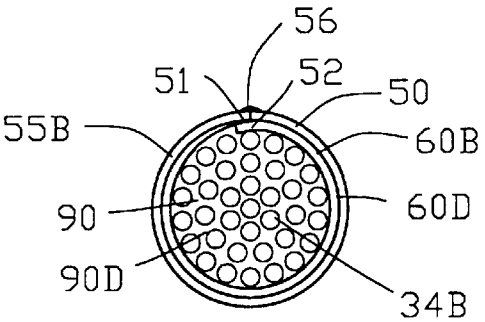
FIG. 23A is an end view of FIG. 23.
Figure 22:
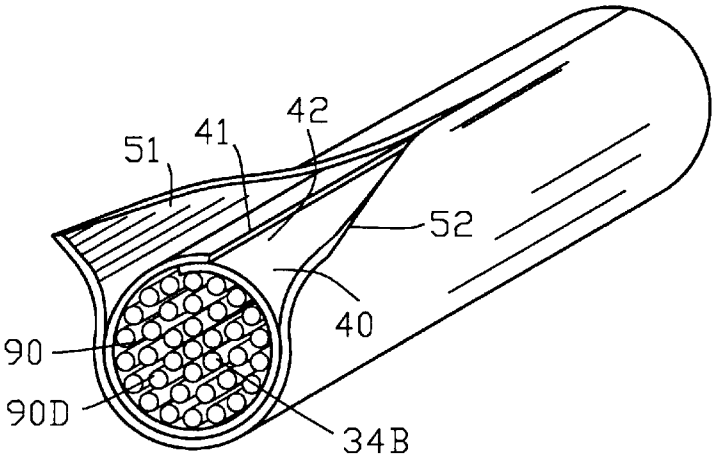
FIG. 22 is an isometric view of an initial process of forming a second tube about the second casing of FIG. 19 with a second cladding material.
Figure 22A:
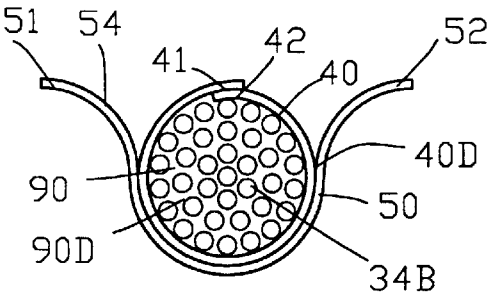
FIG. 22A is an end view of FIG. 22.

FIG. 17 is a block diagram illustrating a second improved process 10A for making ultra fine metallic fibers that is a variation of the process 10 illustrated in FIG. 1. The initial process steps 11A–17A of the second improved process 10A of FIG. 17 are identical to the initial process steps 11–17 the first improved process 10 of FIG. 1.

The improved process 10A of FIG. 17 comprises the process step 11A of providing multiple coated metallic wires 20A in a manner similar to FIGS. 2 and 2A with each of the metallic wires 20A having a coating material 30A as shown in FIGS. 3 and 3A. The plurality of the metallic wires 20A with the coating material 30A are formed into an assembly 34A of metallic wires 20A.

FIG. 17 illustrates an optional process step 12A of encasing the assembly 34A of metallic wires 20A with a casing material 40. FIGS. 4, 4A, 5 and 5A illustrate similar steps in a first example of the optional process step 12A of encasing the assembly 34A of metallic wires 20A with the casing material 40 to create a first casing 44A. FIGS. 6, 6A, 7 and 7A illustrate similar steps in a second example of the optional process step 12A of encasing the assembly 34A of metallic wires 20A with the casing material 40 to create a first casing 44A.

FIG. 17 illustrates the process step 13A of preparing a cladding material 50 with a release material 54 to inhibit chemical interaction between the cladding material 50 and the plurality of metallic wires 20A or the casing material 40. The release material 54 may be applied in any suitable way and as set forth above.

FIG. 17 illustrates the process step 14A of forming a continuous first tube 55A of the cladding material 50 about the plurality of metallic wires 20A or the casing material 40. FIGS. 8, 8A, 9 and 9A illustrate the process of forming the continuous first tube 55A of the cladding material 50 about the plurality of metallic wires 20A and the casing material 40. The first and second edges 51 and 52 of the cladding material 50 is bent about the plurality of metallic wires 20 and the casing material 40 to form a first cladding 60A.

FIG. 17 illustrates the process step 15A of drawing the first cladding 60A. The process step 15 of drawing the first cladding 60A provides the four effects as set forth above. FIG. 10 illustrates the first cladding 60A after the first drawing process. The drawing of the first cladding 60 causes the diffusion welding of the coating materials 30A on adjacent metallic wires 20A and the casing material 40. The diffusion welding of the coating material 30A and the casing material 40 forms a first unitary material 70A.

FIG. 17 illustrates the process step 16A of mechanically removing the first tube 55A. FIG. 11 shows the mechanical removal of the first tube 55A. The first tube 55A is scored or cut at 71 and 72 by mechanical scorers or cutters and tube portions 73A and 74A are mechanically pulled apart to peel the first tube 55A leaving a first remainder 80A. The first remainder 80A comprises the substantially first unitary material 70 with the plurality of metallic wires 20A contained therein.

FIG. 17 illustrates the process step 17A of drawing the first remainder 80A for reducing the outer diameter 80D thereof and for reducing the corresponding outer diameter 20D of the plurality of metallic wires 20A contained therein. The plurality of wires 20A are reduced into a plurality of fine metallic fibers 90 by the process step 17A of drawing the remainder 80 in a manner similar to FIG. 12.

FIG. 17 illustrates the process step 11B of providing a plurality of the first remainders 80A similar to FIG. 12. The plurality of the first remainders 80A are formed into an assembly 34B. The assembly 34B of the plurality of the first remainders 80A may be encased with the casing material 40.

FIGS. 18, 18A, 19 and 19A illustrate the steps in a first example of the optional process of encasing the assembly 34B of the first remainders 80A with the casing material 40 to form a second casing 44B. The first example of the optional process step of encasing the assembly 34B of the first remainders 80A is shown in FIGS. 18, 18A, 19 and 19A is substantially identical to FIGS. 4, 4A, 5 and 5A.

FIGS. 20, 20A, 21 and 21A illustrate the steps in a second example of the optional process of encasing the assembly 34B of the first remainders 80A with the casing material 40 to form a second casing 44B. The second example of the optional process of encasing the assembly 34B of the first remainders 80A in FIGS. 20, 20A, 21 and 21A is substantially identical to FIGS. 6, 6A, 7 and 7A.

FIG. 17 illustrates the process step 13A of preparing a cladding material 50 with a release material 54 to inhibit chemical interaction between the cladding material 50 and the plurality of first remainders 80A or the casing material 40. The process step 13A of preparing a cladding material 50 with a release material 54 is applied prior to the to the process step 14B of forming a second continuous tube 55B of the cladding material 50 about the plurality of the first remainders 80A or the casing material 40.

FIG. 17 illustrates the process step 14B of forming the second continuous tube 55B of the cladding material 50 about the plurality of the first remainders 80A or the casing material 40. The process step 14B of forming the second continuous tube 55B of the cladding material 50 about the plurality of the first remainders 80A or the casing material 40 is substantially identical to the process step 14A of forming the first continuous tube 55A of the cladding material 50 about the plurality of metallic wires 20A and the casing material 40.

FIGS. 22, 22A, 23 and 23A illustrate the process of forming the second continuous tube 55B of the cladding material 50 about the plurality of first remainders 80A and the casing material 40. The first and second edges 51 and 52 of the cladding material 50 is bent about the plurality of first remainders 80A and the casing material 40 to form a second cladding 60B.

FIG. 17 illustrates the process step 15B of drawing the second cladding 60B. The process step 15 of drawing the second cladding 60B provides the four effects. Firstly, the process step 15B reduces an outer diameter 60D of the second cladding 60B. Secondly, the process step 15B reduces the corresponding outer diameter of each of the plurality of metallic fibers 90 within each of the plurality of first remainders 80A. Thirdly, the process step 15B causes the unitary first material 70A of each of the plurality of first remainders 80A to diffusion weld with the first unitary material 70A of each adjacent plurality of first remainders 80A to form a second unitary material 70B. Fourthly, the process step 15B causes the casing material 40 to diffusion weld with the first unitary material 70A of each adjacent plurality of first remainders 80A.

Figure 24:
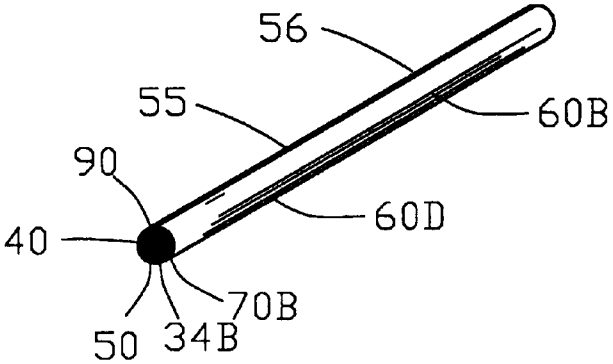
FIG. 24 is an isometric view of the second cladding of FIG. 23 after a third drawing process.
Figure 24A:
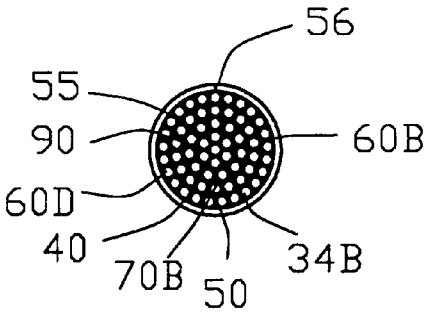
FIG. 24A is an enlarged end view of FIG. 24.

FIG. 24 illustrates the second cladding 60B after the third drawing process. The drawing the second cladding 60B causes the diffusion welding of the first unitary material 70A on the adjacent first remainders 80A and the casing material 40. The diffusion welding of the first unitary material 70A on the adjacent first remainders 80A and the casing material 40 forms the second unitary material 70B.

Figure 25:
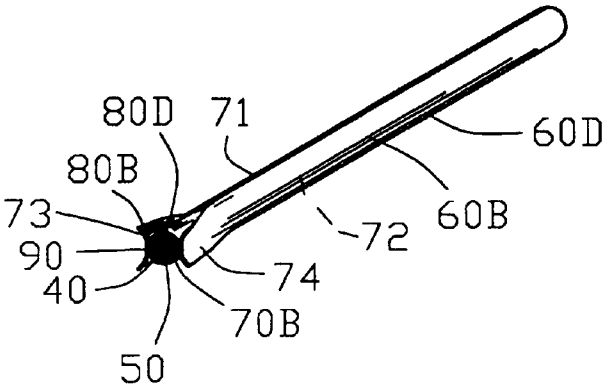
FIG. 25 is an isometric view illustrating the mechanical removal of the second tube after the third drawing process of FIG. 10.
Figure 25A:
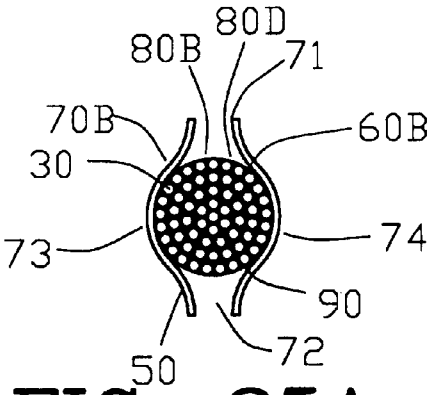
FIG. 25A is an enlarged end view of FIG. 25.

FIGS. 25 and 25A show the mechanical removal of the second tube 55B illustrated by the process step 16B of FIG. 17. The second tube 55B is scored or cut at 71 and 72 by mechanical scorers or cutters and tube portions 73B and 74V are mechanically pulled apart to peel the second tube 55B leaving a second remainder 80B. The second remainder 80B comprises the substantially second unitary material 70B with the plurality of metallic fibers 90 contained therein.

Figure 26:
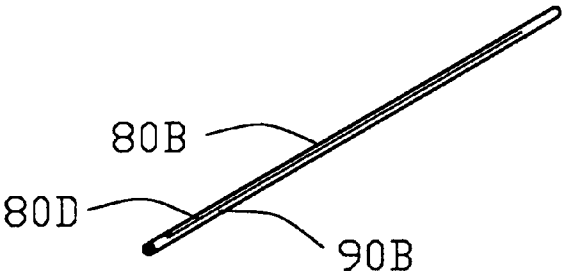
FIG. 26 is an isometric view of the second casing of FIG. 25 after a fourth drawing process.
Figure 26A:
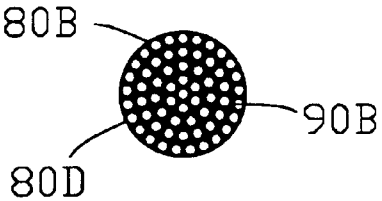
FIG. 26A is an enlarged end view of FIG. 26.

FIG. 26 is an isometric view of the plurality of fibers 90 of FIG. 25 reduced to a plurality of ultra fine metallic fibers 90B by the process step 17B of drawing the second remainder 80B. FIG. 26A is an enlarged end view of FIG. 26. The drawing of the second remainder 80B reduces the outer diameter 80D thereof and reduces the corresponding outer diameter 90D of the plurality of metallic fibers 90 contained therein.

Figure 27:
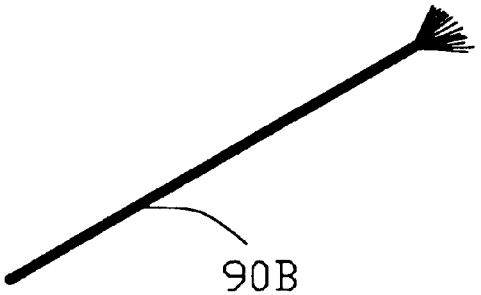
FIG. 27 is an isometric view of the plurality of the ultra fine metallic fibers of FIG. 26 after removal of the coating material.
Figure 27A:
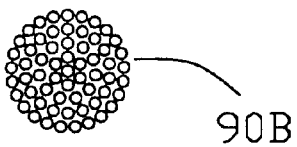
FIG. 27A is an enlarged end view of FIG. 27.

FIG. 27 is an isometric view of the plurality of the ultra fine metallic fibers 90B of FIG. 26 after the process step 18B shown in FIG. 17 of removing the second unitary material 70B. FIG. 27A is an enlarged end view of FIG. 27. Preferably, the second unitary material 70B is removed by an acid leaching process for dissolving the second unitary material 70B to provide a plurality of ultra fine metallic fibers 90B. One example of the process step 18B includes an acid leaching process as set forth heretofore with reference to the process step 18.

FIGS. 28–33 are diagrams illustrating a first through sixth portions of an apparatus 200 for performing the first improved process 10A of forming the ultra fine metallic fibers 90B shown in FIG. 17. The process steps 11A–17A and 11B–18B are displayed adjacent the respective region of the apparatus 200 accomplishing the respective process step.

Figure 28:
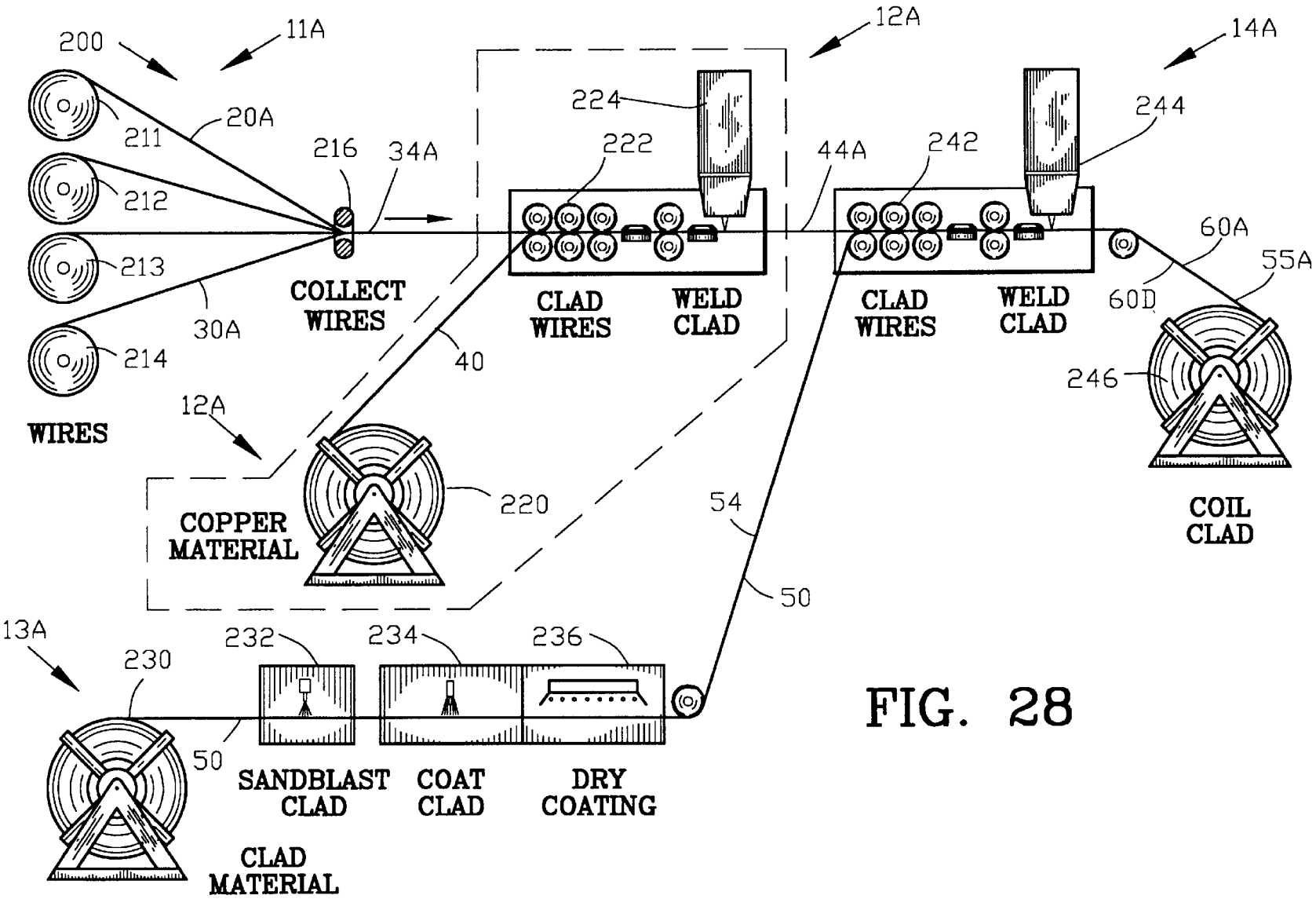
FIG. 28 is a diagram illustrating a first portion of a second apparatus for performing the second improved process of forming ultra fine metallic fibers shown in FIG. 17.

FIG. 28 illustrates a plurality of spools 211–214 containing the plurality of metallic wires 20A with the coating material 30A. Although FIG. 28 only shows four spools, it should be understood that between 150 and 1200 spools are typically provided in the apparatus 200. The plurality of metallic wires 20A with the coating material 30A are collected by a collar 216 to form the first assembly 34A of the plurality of metallic wires 20A.

A spool 220 contains the casing material 40 for encasing the first assembly 34A of metallic wires 20A. The casing material 40 is drawn from the spool 220 by a series of rollers 222. The series of rollers 222 bend the casing material 40 about the first assembly 34A of the plurality of the wires 20A with the first edge 41 of the casing material 40 overlapping the second edge 42 of the casing material 42 to form a first casing 44A similar to FIGS. 4, 4A, 5 and 5A. In the alternative, the series of rollers 222 bend the casing material 40 about the first assembly 34A of the plurality of the wires 20A with the first edge 41 of the casing material 40 abutting the second edge 42 of the casing material 42. A welder 224 welds the abutting first and second edges 41 and 42 of the casing material 40 to form the first casing 44A similar to FIGS. 6, 6A, 7, and 7A.

A spool 230 contains the cladding material 50 for cladding the first assembly 34A of metallic wires 20A and the casing material 40. The cladding material 50 is a longitudinally extending cladding material 50 having a first and a second edge 51 and 52. The surface of the cladding material 50 is cleaned by suitable means such as a sandblaster 232. Although the cleaning process has been shown as a sandblaster 232, it should be understood that the surface of the cladding material 50 may be cleaned by other suitable means as should be understood by those skilled in the art.

The surface of the cladding material 50 is treated with a release material 54 to inhibit chemical interaction between the cladding material 50 and the plurality of metallic wires 20A or the casing material 40. In this example, the release material 54 is applied by flame spraying 234 aluminum to the surface of the cladding material 50. The aluminum forms alumina or aluminum oxide that is bonded to the surface of the cladding material 50. In the alternative, the release material 54 may be applied by a plasma gun, painting or any other suitable means. A dryer 236 drys the coated release material 54 on the surface of the cladding material 50.

A series of rollers 242 bends the cladding material 50 to form the continuous first tube 55A about the plurality of metallic wires 20A or the casing material 40. In this example, the cladding material 50 is a carbon steel material with the plurality of metallic wires 20A being made of a stainless steel material. The coating material 30A and the casing material 40 are preferably a copper material. The series of rollers 242 bends the first and second edges 51 and 52 of the longitudinally extending sheet of the cladding material 50 to form a first cladding 60A for enclosing the casing material 40. The first edge 51 of the cladding material 50 abuts the second edge 52 of the cladding material 50. A welder 244 welds the first edge 51 of the cladding material 50 to the second edge 52 of the cladding material 50 to form the first tube 55A. The completed first cladding 60A is rolled on a spool 246.

Figure 29:
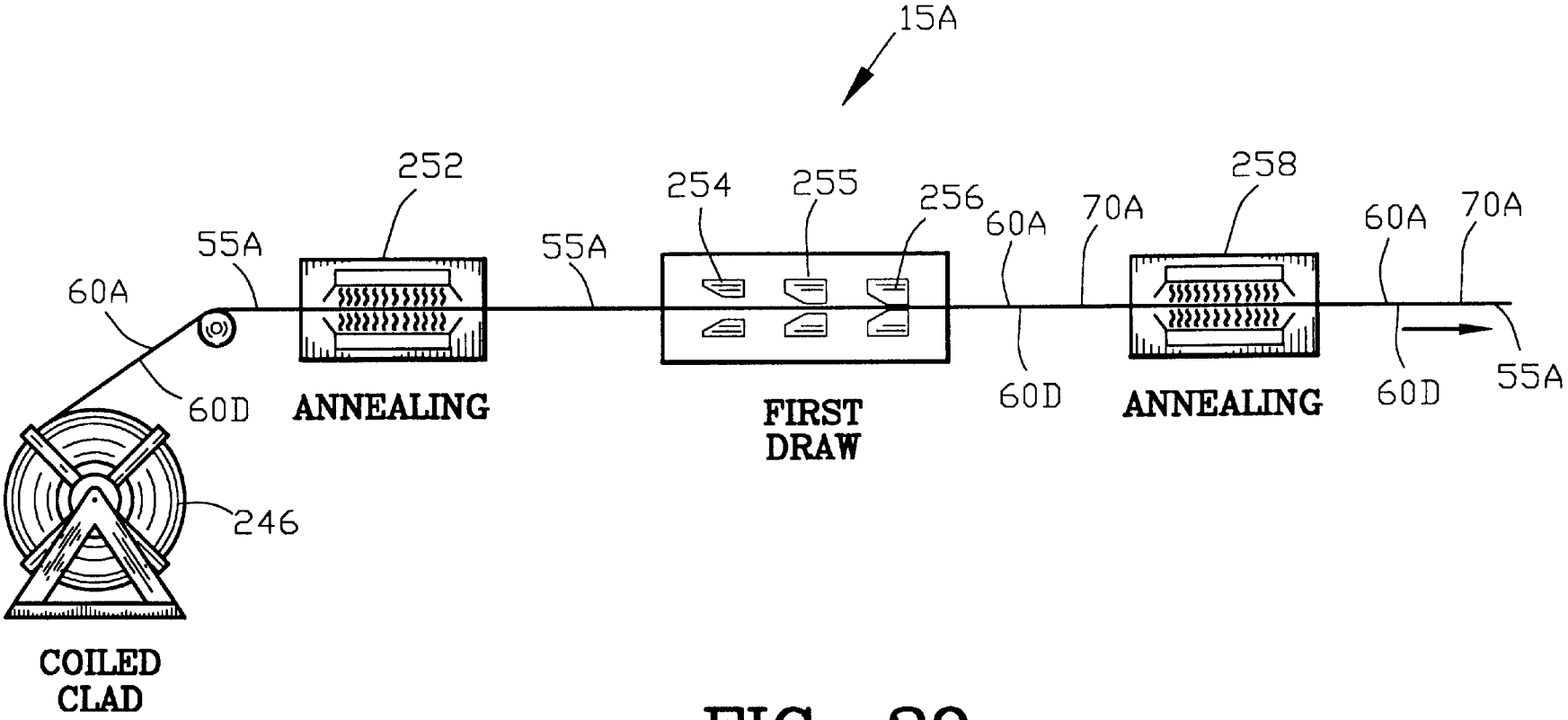
FIG. 29 is a diagram illustrating a second portion of the apparatus of FIG. 28.

FIG. 29 illustrates the second portion of the apparatus 200 for performing the first improved process 10A shown in FIG. 17. The first cladding 60A is unrolled from the spool 246 and is pulled through an annealing oven 252 for annealing the first cladding 60A.

The first cladding 60A is drawn through a series of dies 254–256 for reducing an outer diameter 60D of the first cladding 60A. In addition, the drawing of the first cladding 60A causes the coating materials 30A and the optional casing material 40 to diffusion weld with the coating materials 30A on adjacent metallic wires 20A to form the first unitary material 70A.

The release material 54 deposited on the cladding material 50 inhibits the chemical interaction or bonding between the first tube 55A and a plurality of metallic wires 20A and the coating materials 30A and the casing material 40 within the first tube 55A. The first cladding 60A is pulled through an annealing oven 258 for annealing the first cladding 60A.

Figure 30:
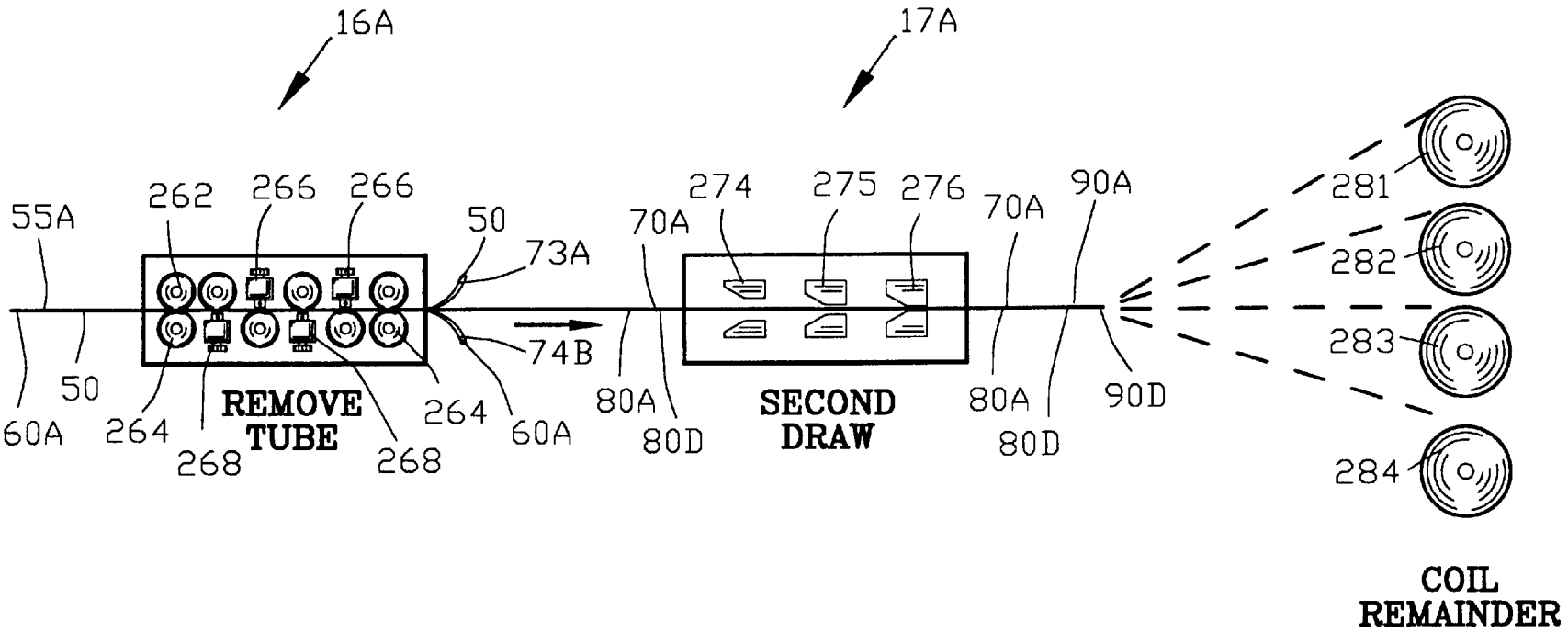
FIG. 30 is a diagram illustrating a third portion of the apparatus of FIG. 28.

FIG. 30 illustrates the third portion of the apparatus 200 for performing the first improved process 10A shown in FIG. 17. The first tube 55A is passed through a series of upper and lower rollers 262 and 264 for positioning the first tube 55A between a series of upper and lower cutting blades 266 and 268. The upper and lower cutting blades 266 and 268 make the scores or cuts 71 and 72 similar to FIGS. 11 and 11A in the first cladding 60A. The tube portions 73A and 74A are mechanically pulled apart to peel the first tube 55A leaving a first remainder 80A. The first remainder 80A comprises the substantially first unitary material 70A with the plurality of metallic wires 20 contained therein.

The first remainder 80A is drawn through a series of dies 274–276 for reducing an outer diameter 80D of the first remainder 80A and for reducing the corresponding outer diameter 20D of the plurality of metallic wires 20 contained therein. The first remainder 80A is drawn for reducing the outer diameter 80D of the first remainder 80A and for transforming the plurality of metallic wires 20 into a plurality of fine metallic fibers 90A. The first remainder 80A is rolled onto a plurality of spool 281–284.

Figure 31:
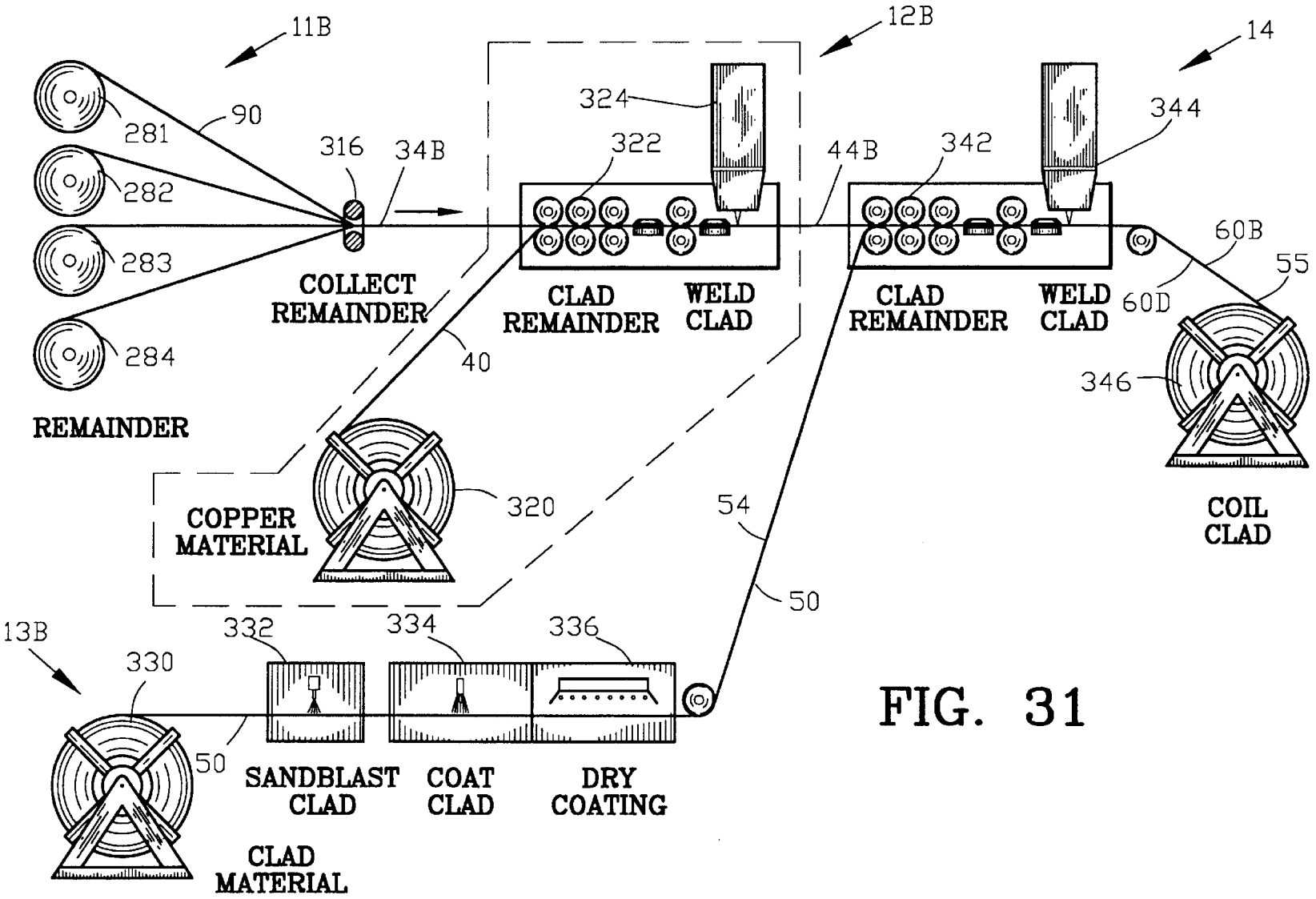
FIG. 31 is a diagram illustrating a fourth portion of the apparatus of FIG. 28.

FIG. 31 illustrates the fourth portion of the apparatus 200 for performing the first improved process 10A shown in FIG. 17. Although FIG. 31 only shows four spools containing the plurality of first remainders 90A, it should be understood that between 170 and 1200 spools are typically provided in the apparatus 200. The plurality of first remainders 90A are collected by a collar 316 to form a second assembly 34B of the plurality of first remainders 90A.

A spool 320 contains the casing material 40 for encasing the second assembly 34B of first remainders 90A. The casing material 40 is drawn from the spool 320 by a series of rollers 322. The series of rollers 322 bend the casing material 40 about the second assembly 34B of the first remainders 90A with the first edge 41 of the casing material 40 overlapping the second edge 42 of the casing material 42 to form a second casing 44B shown in FIG. 18, 18A, 19 and 19A. In the alternative, the series of rollers 322 bend the casing material 40 about the second assembly 34B of the plurality of the first remainders 90A with the first edge 41 of the casing material 40 abutting the second edge 42 of the casing material 42. A welder 324 welds the abutting first and second edges 41 and 42 of the casing material 40 to form the second casing 44B shown in FIG. 21, 21A, 22 and 23A.

A spool 330 contains the cladding material 50 for cladding the second assembly 34B of the plurality of the first remainders 90A and the casing material 40. The cladding material 50 is a longitudinally extending cladding material 50 having a first and a second edge 51 and 52. The surface of the cladding material 50 is cleaned by suitable means such as a sandblaster 332. The release material 54 is applied by flame spraying 334 aluminum to the surface of the cladding material 50. A dryer 336 drys the coated release material 54 on the surface of the cladding material 50.

A series of rollers 342 bends the cladding material 50 to form the continuous second tube 55B about the plurality of the first remainders 90A or the casing material 40. In this example, the cladding material 50 is a carbon steel material with the plurality of the first remainders 90A being made of a stainless steel material. The series of rollers 342 bends the first and second edges 51 and 52 of the longitudinally extending sheet of the cladding material 50 to form a second cladding 60B for enclosing the casing material 40. A welder 344 welds the first edge 51 of the cladding material 50 to the second edge 52 of the cladding material 50 to form the second tube 55B. The completed first cladding 60A is rolled on a spool 346.

Figure 32:
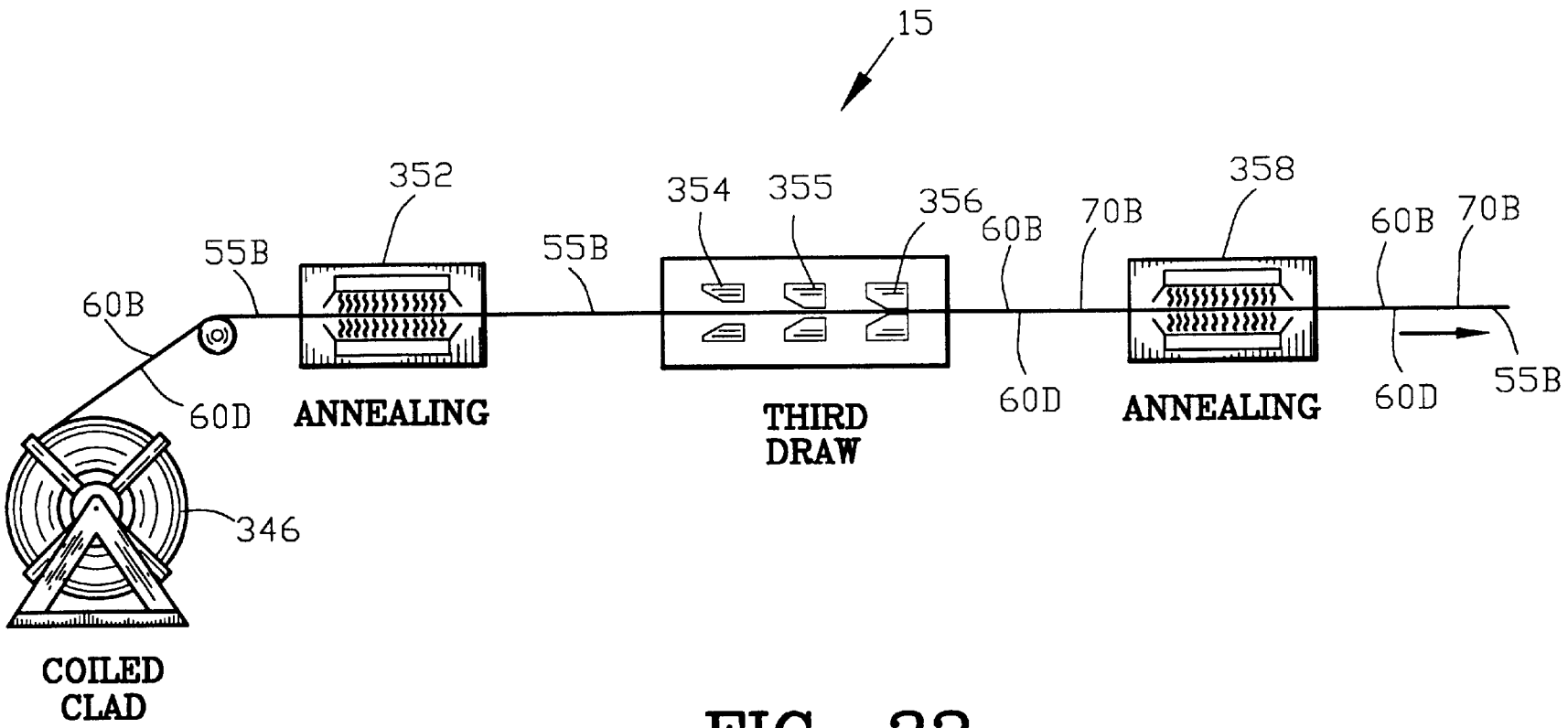
FIG. 32 is a diagram illustrating a fifth portion of the apparatus of FIG. 28.

FIG. 32 illustrates the fifth portion of the apparatus 200 for performing the first improved process 10A shown in FIG. 17. The second cladding 60B is unrolled from the spool 346 and is pulled through an annealing oven 352 for annealing the second cladding 60B.

The second cladding 60B is drawn through a series of dies 354–356 for reducing an outer diameter 60D of the second cladding 60B and to form a second unitary material 70B. The second cladding 60B is pulled through an annealing oven 358 for annealing the second cladding 60B.

Figure 33:
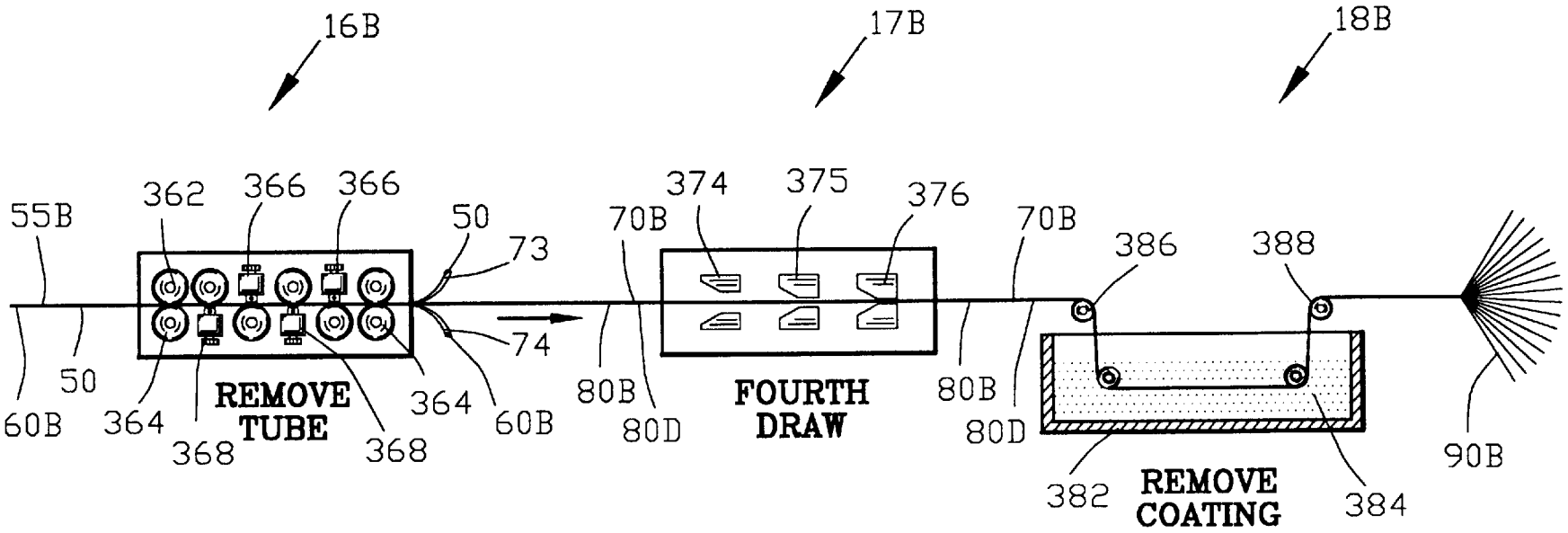
FIG. 33 is a diagram illustrating a sixth portion of the apparatus of FIG. 28.

FIG. 33 illustrates the sixth portion of the apparatus 200 for performing the first improved process 10A shown in FIG. 17. The second tube 55B is passed through a series of upper and lower rollers 362 and 364 for positioning the second tube 55B between a series of upper and lower cutting blades 366 and 368. The upper and lower cutting blades 366 and 368 make the scores or cuts 71 and 72 as shown in FIG, 25 and 25A in the second cladding 60B. The tube portions 73B and 74B are mechanically pulled apart to peel the second tube 55B leaving a second remainder 80B. The first remainder 80B comprises the second unitary material 70B with the plurality of metallic fibers 90A contained therein.

The second remainder 80B is drawn through a series of dies 374–376 for reducing an outer diameter 80D of the second remainder 80B and for transforming the plurality of fine metallic fibers 90A into a plurality of ultra fine metallic fibers 90B.

The plurality of the ultra fine metallic fibers 90B are directed into a reservoir 382 containing a chemical agent 384 by rollers 386 and 388. The chemical agent 384 removes the second unitary material 70B. Preferably, the chemical agent 384 is an acid for dissolving the second unitary material 70B to provide a plurality of ultra fine metallic fibers 90B.

Figure 34:
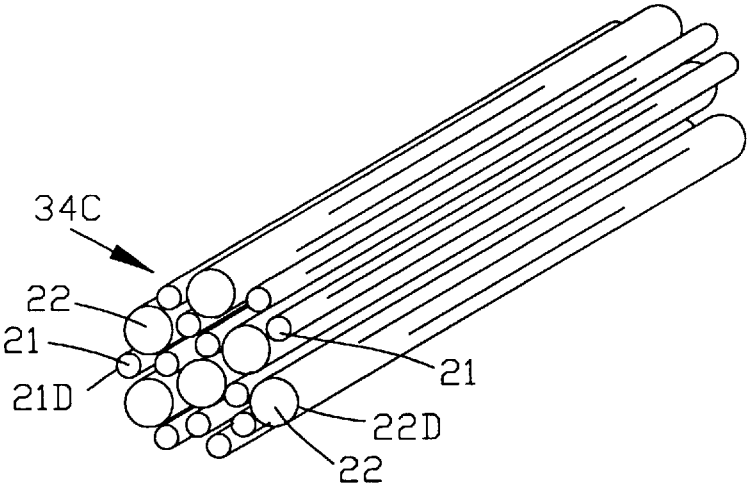
FIG. 34 is an isometric view of a first example of an assembly of a multiplicity of mixed first and second coated metallic wires.

FIG. 34 is an isometric view of a second example of an assembly 34C of a plurality of first and second metallic wires 21 and 22. The first metallic wires 21 have a first diameter 21D whereas the second metallic wires 22 have a second diameter 22D. The first and second metallic wires 21 and 22 may be of the same composition or the first metallic wires 21 may be of a different composition than the second metallic wire 22. The first and second metallic wires 21 and 22 form a mixed assembly 34C suitable for use as the assemblies 34 set forth in FIGS. 1–27. In this example, the first and second metallic wires 21 and 22 are randomly located within the assembly 34C.

Figure 35:
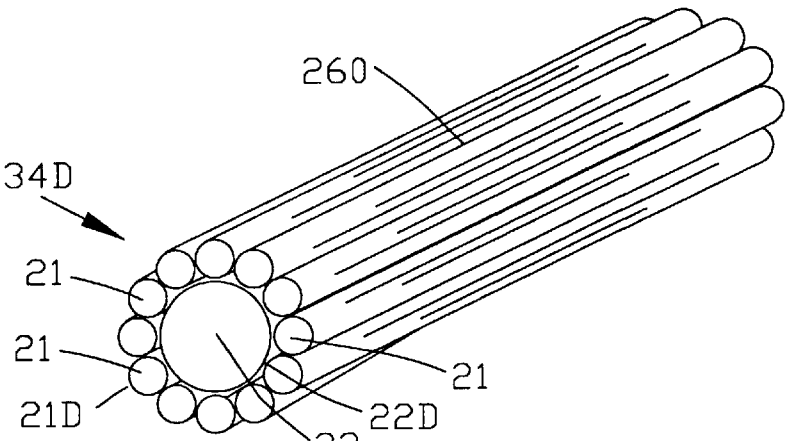
FIG. 35 is an isometric view of a second example of an assembly of a multiplicity of mixed first and second coated metallic wires.

FIG. 35 is an isometric view of a third example of an assembly 34D of a plurality of first and second metallic wires 21 and 22. The first metallic wires 21 have a first diameter 21D whereas the second metallic wires 22 have a second diameter 22D. In this example, the ratio of the first and second metallic wires 21 and 22 is altered relative to the assembly 34C of FIG. 34.

In addition, the plurality of first and second metallic wires 21 and 22 are twisted to form a strand. The strand comprises a twisted assembly 34D of the plurality of first and second metallic wires 21 and 22. Preferably, the first and second metallic wires 21 and 22 are twisted into a helical pattern to provide the strand at the rate of 1.5 turns per 2.5 centimeters. The strand 260 may be coiled for on a spool (not shown) for temporary storage. A multiplicity of the stands 260 may be collected from a multiplicity of the spools (not shown) for forming an array of the strands 260. The array of the strands 260 may be used during the process step 14 of FIGS. 1 or 17.

Figure 36:
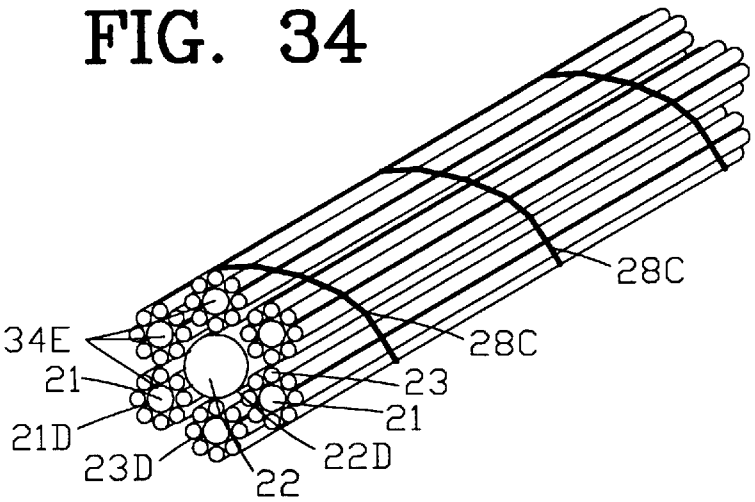
FIG. 36 is an isometric view of a third example of an array of a multiplicity of assemblies of the first and second coated metallic wires.

FIG. 36 is an isometric view of a fourth example of an array of assemblies 34E of a first, a second and a third coated metallic wire 21, 22 and 23. The first metallic wires 21 have a first diameter 21D, the second metallic wires 22 have a second diameter 22D and the third metallic wires 23 have a third diameter 23D. In this example, each of the array of the assemblies 34E are bound with a wrapping material 28C for maintaining the integrity of the assembly 34E during the process step 12 in FIGS. 1 and 17. Preferably, the wrapping material 28C is the same material as the coating materials 31 and 32.

Figure 37:
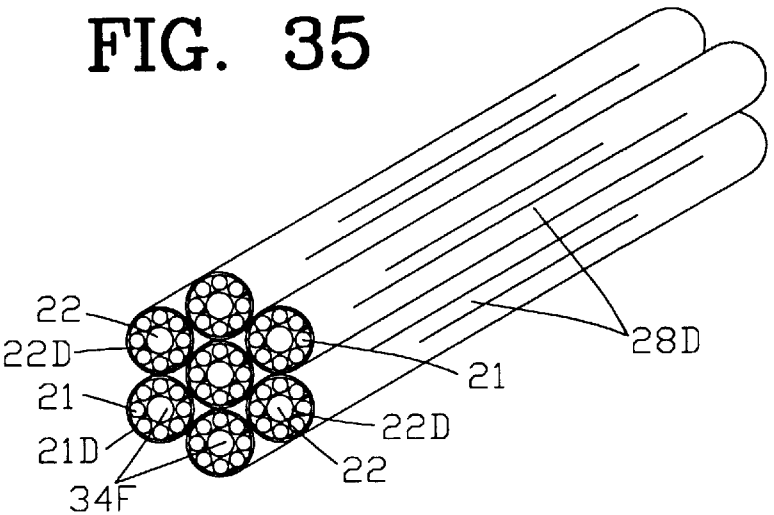
FIG. 37 is an isometric view of a fourth example of an array of a multiplicity of assemblies of the first and second coated metallic wires.

FIG. 37 is an isometric view of a fifth example of an array of assemblies 34F of the first, second and third plurality of metallic wires 21, 22 and 23. In this example, a wrapping material 28D binds each of the plurality of assemblies 34F of the first, second and third coated metallic wires 21, 22 and 23. The wrapping material 28D is shown as a continuous sheet of wrapping material 28D for providing a plurality of bound assemblies 34F. Preferably, the wrapping material 28D is made from the same material as the coating materials 31 and 32.

Figure 38:
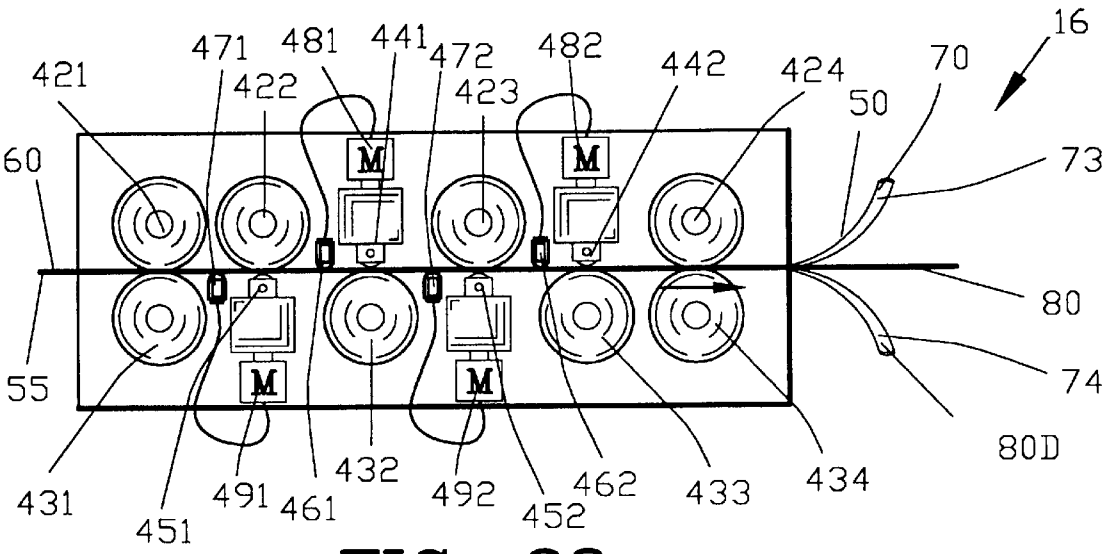
FIG. 38 is an enlarged view of a portion of FIGS. 16, 30 and 33 illustrating a variable cutting assembly for scoring or cutting the cladding material.

FIG. 38 is an enlarged view of a portion of FIGS. 16, 30 and 33 illustrating a variable cutting assembly for scoring or cutting the cladding material 50. In this embodiment, a series, of upper rollers 421–424 and a series of lower rollers 431–434 position the tube 55 between a series of upper cutting blades 441 and 442 and a series of lower cutting blades 451 and 452.

A series of upper sensors 461 and 462 are located adjacent and upstream from the series of the upper cutting blades 441 and 442. A series of lower sensors 471 and 472 are located adjacent and upstream from the series of lower cutting blades 451 and 452. The upper sensors 461 and 464S are connected through positioners 481 and 482 for controlling the vertical positions of the upper cutting blades 441 and 442. The lower sensors 471 and 472 are connected through positioners 491 and 492 for controlling the vertical positions of the lower cutting blades 451 and 452.

Figure 40:
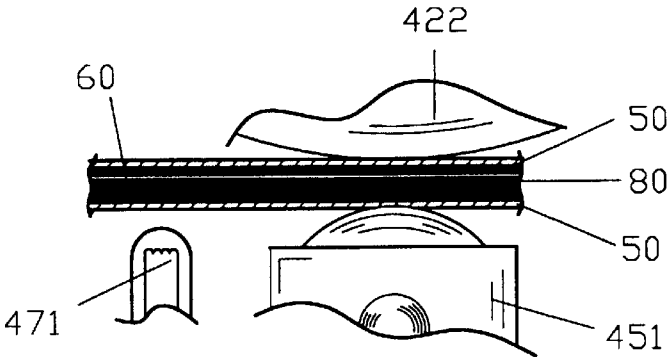
FIG. 40 is an enlarged view of a portion of FIG. 38 illustrating the cutting blade in a second position.
Figure 39:
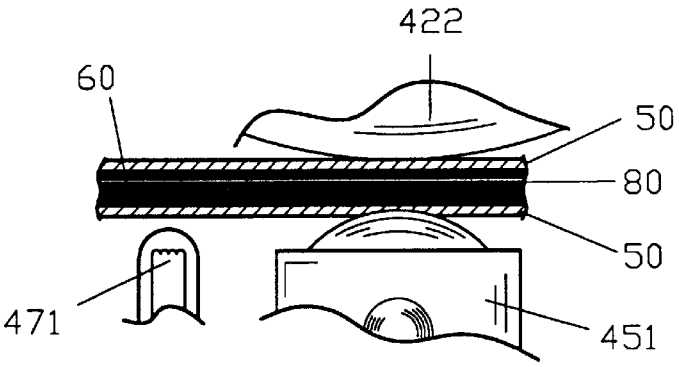
FIG. 39 is an enlarged view of a portion of FIG. 38 illustrating a cutting blade in a first position.

FIGS. 39 and 40 are enlarged views of a portion of FIG. 38 illustrating the upper cutting blades 441 and 442 and the lower cutting blades 451 and 452 in a first and a second position. As the tube 55 passes through the series of upper rollers 421–424 and the lower rollers 431–434, the upper sensors 461 and 462 and the lower sensors 471 and 472 sense the thickness of the upper and lower cladding material 50 of the cladding 60. The upper sensors 461 and 462 actuate the positioners 481 and 482 to adjust the vertical positions of the upper cutting blades 441 and 442 in accordance with the thickness of the upper cladding material 50 of the cladding 60. Similarly, the lower sensors 471 and 472 actuate the positioners 491 and 492 to adjust the vertical positions of the lower cutting blades 451 and 452 in accordance with the thickness of the lower cladding material 50 of the cladding 60.

The present invention provides an apparatus and process for constructing fined and ultra fine metallic fibers. A typical example may include the initial cladding of 1200 stainless steel wires each having a diameter of 0.010. The assembly of the 1200 stainless steel wires is drawn to a remainder diameter of 0.009 inches. Thereafter, a second cladding of 1200 remainders is assembled and draw as heretofore described. Reducing second cladding to an overall diameter to 0.006 inches will produce ultra-fine fiber having a diameter of 0.06 microns.

The present invention provides fine and ultra-fine fibers having mixed diameter. The mixed fibers provide height surface area, high strength, increased holding capacity for the applications to numerous to mention. The mixed fine and ultra fibers are capable of being prepared into media by a wet preparation or a dry preparation process.

The fine fibers may be used as a filter media, catalyst carrier, or any other suitable to a used for such media. The ultra-find membranes provide nanometer size fibers for use in ultra filtration of liquids and gases. For example ultra-fine fibers may be used in membranes for filtration of gases in the construction of semiconductors as well in various other applications such as the filtration of the blood and other bodily fluids.

Although the aforementioned specification has been set forth with reference to making the stainless steel fined an ultra-fine fibers, it should be understood that the apparatus and process of the invention is suitable for use with a wide variety of metals and types of fibers. It should be understood that various other materials may be used in the present process and that the number and dimensions set forth herein are only by way of example and that once skilled in the art may vary the disclosed process based on the disclosure of the present invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A process for making fine metallic fibers comprising:

coating a plurality of metallic wires with a coating material;

forming a continuous tube about the plurality of metallic wires for providing a cladding;

drawing the cladding for reducing the outer diameter thereof and for reducing the cross-section of each of the plurality of metallic wires within the cladding and for diffusion welding the coating material within the cladding to form a substantially unitary coating material with the plurality of metallic wires contained therein;

mechanically removing the tube to provide a remainder comprising the diffusion welded coating material with the plurality of metallic wires contained therein;

drawing the remainder for reducing the diameter thereof and for reducing the corresponding cross-section of each of the plurality of metallic wires contained therein to transform the plurality of metallic wires into a plurality of fine metallic fibers; and removing the diffusion welded coating material from the remainder for providing the plurality of fine metallic fibers.

2. A process for making fine metallic fibers as set forth in claim 1, wherein the step of coating the plurality of metallic wires with a coating material includes electroplating the coating material onto the plurality of metallic wires.

3. A process for making fine metallic fibers as set forth in claim 1, wherein the step of coating a plurality of metallic wires with a coating material includes coating a first plurality of metallic wires and coating a second plurality of metallic wires.

4. A process for making fine metallic fibers as set forth in claim 1, wherein the step of coating a plurality of metallic wires with a coating material includes coating a first plurality of metallic wires and coating a second plurality of metallic wires with the first plurality of metallic wires having a smaller diameter than the second plurality of metallic wires.

5. A process for making fine metallic fibers as set forth in claim 1, including the step of treating an interior of the continuous tube with a release material to inhibit chemical interaction between the continuous tube and the plurality of coated metallic wires within the continuous tube.

6. A process for making fine metallic fibers as set forth in claim 1, including the step of treating an interior of the continuous tube with a release material prior to the formation of the continuous tube to inhibit chemical interaction between the continuous tube and the plurality of coated metallic wires within the continuous tube.

7. A process for making fine metallic fibers as set forth in claim 1, including the step of treating an interior of the continuous tube with a release material with a quantity sufficient to inhibit chemical interaction between the continuous tube and the plurality of coated metallic wires within the continuous tube and with the quantity of the release material being insufficient to inhibit the diffusion weld of the coating materials on adjacent coated metallic wires.

8. A process for making fine metallic fibers as set forth in claim 1, including the step of treating an interior of the continuous tube with a release material by flame spraying the release material onto the interior of the continuous tube.

9. A process for making fine metallic fibers as set forth in claim 1, wherein the step of forming the continuous tube about the plurality of metallic wires includes forming a longitudinally extending sheet of cladding material into a continuous tube about the plurality of metallic wires.

10. A process for making fine metallic fibers as set forth in claim 1, wherein the step of forming the continuous tube about the plurality of metallic wires includes bending a first and a second edge of a longitudinally extending sheet of cladding material to form the continuous tube with the first edge of the cladding material abutting the second edge of the cladding material; and welding the first edge of the cladding material abutting to the second edge of the cladding material.

11. A process for making fine metallic fibers as set forth in claim 1, wherein the step of drawing the cladding for reducing the outer diameter thereof comprises drawing the cladding for diffusion welding the coating material within the cladding to form a substantially unitary coating material with the plurality of metallic wires contained therein.

12. A process for making fine metallic fibers as set forth in claim 1, wherein the step of removing the coating material includes chemically removing the coating material for providing the plurality of fine metallic fibers.

13. A process for making fine metallic fibers as set forth in claim 1, wherein the step of removing the coating material includes immersing the remainder into an acid for dissolving the coating material for providing the plurality of fine metallic fibers.

14. A process for making fine metallic fibers as set forth in claim 1, including the step of treating an interior of the continuous tube with a release material prior to the formation of the continuous tube to inhibit chemical interaction between the continuous tube and the plurality of coated metallic wires within the continuous tube.

15. A process for making fine metallic fibers comprising:

coating a plurality of metallic wires with a coating material;

forming the plurality of metallic wires into an assembly of metallic wires;

encasing the assembly of metallic wires with a wrapping material for providing a bound assembly;

forming a continuous tube about the bound assembly for providing a cladding;

drawing the cladding for reducing the outer diameter thereof and for reducing the cross-section of each of the plurality of metallic wires within the cladding and for diffusion welding the coating material and the wrapping material within the cladding to form a substantially unitary coating material with the plurality of metallic wires contained therein;

mechanically removing the tube to provide a remainder comprising the diffusion welded coating material and the wrapping material with the plurality of metallic wires contained therein;

drawing the remainder for reducing the diameter thereof and for reducing the corresponding cross-section of each of the plurality of metallic wires contained therein to transform the plurality of metallic wires into a plurality of fine metallic fibers; and removing the diffusion welded coating material and the wrapping material from the remainder for providing the plurality of fine metallic fibers.

16. A process for making fine metallic fibers as set forth in claim 15, wherein the step of coating the plurality of metallic wires with a coating material includes electroplating the coating material onto the plurality of metallic wires.

17. A process for making fine metallic fibers as set forth in claim 15, wherein the step of coating a plurality of metallic wires with a coating material includes coating a first plurality of metallic wires and coating a second plurality of metallic wires.

18. A process for making fine metallic fibers as set forth in claim 15, wherein the step of coating a plurality of metallic wires with a coating material includes coating a first plurality of metallic wires and coating a second plurality of metallic wires with the first plurality of metallic wires having a smaller diameter than the second plurality of metallic wires.

19. A process for making fine metallic fibers as set forth in claim 15, including the step of treating an interior of the continuous tube with a release material to inhibit chemical interaction between the continuous tube and the plurality of coated metallic wires within the continuous tube.

20. A process for making fine metallic fibers as set forth in claim 15, wherein the step of mechanically removing the tube comprises cutting the tube and peeling the tube from the remainder.

21. A process for making ultra fine metallic fibers comprising:

coating a plurality of metallic wires with a coating material;

forming a continuous tube about the plurality of metallic wires for providing a first: cladding;

drawing the first cladding for reducing the outer diameter thereof and for reducing the cross-section of each of the plurality of metallic wires within the first cladding and for diffusion welding the coating material within the first cladding to form a substantially unitary coating material with the plurality of metallic wires contained therein;

mechanically removing the tube to provide a first remainder comprising the diffusion welded coating material with the plurality of metallic wires contained therein;

drawing the first remainder for reducing the diameter thereof and for reducing the corresponding cross-section of each of the plurality of metallic wires contained therein to transform the plurality of metallic wires into a plurality of fine metallic fibers;

assembling a plurality of the drawn first remainders;

forming a continuous tube about the assembly of drawn first remainders for providing a second cladding;

drawing the second cladding for reducing the outer diameter thereof and for reducing the cross-section of each of the plurality of fine metallic fibers within the second cladding and for diffusion welding the coating material within the second cladding to form a substantially unitary coating material with the plurality of fine metallic fibers contained therein;

mechanically removing the tube to provide a second remainder comprising the diffusion welded coating material with the plurality of fine metallic fibers contained therein;

drawing the second remainder for reducing the diameter thereof and for reducing the corresponding cross-section of each of the plurality of fine metallic fibers contained therein to transform the plurality of fine metallic fibers into a plurality of ultra fine metallic fibers; and removing the diffusion welded coating material from the second remainder for providing the plurality of ultra fine metallic fibers.

22. A process for making fine metallic fibers as set forth in claim 21, wherein the step of coating the plurality of metallic wires with a coating material includes electroplating the coating material onto the plurality of metallic wires.

23. A process for making fine metallic fibers as set forth in claim 21, wherein the step of coating a plurality of metallic wires with a coating material includes coating a first plurality of metallic wires and coating a second plurality of metallic wires.

24. A process for making fine metallic fibers as set forth in claim 21, wherein the step of coating a plurality of metallic wires with a coating material includes coating a first plurality of metallic wires and coating a second plurality of metallic wires with the first plurality of metallic wires having a smaller diameter than the second plurality of metallic wires.

25. A process for making fine metallic fibers as set forth in claim 21, including the step of treating an interior of the continuous tube with a release material to inhibit chemical interaction between the continuous tube and the plurality of coated metallic wires within the continuous tube.

26. A process for making ultra fine metallic fibers comprising:

coating a plurality of metallic wires with a coating material;

forming the plurality of metallic wires into an assembly of metallic wires;

encasing the assembly of metallic wires with a wrapping material for providing a first bound assembly;

forming a continuous tube about the first bound assembly for providing a first cladding;

drawing the first cladding for reducing the outer diameter thereof and for reducing the cross-section of each of the plurality of metallic wires within the first cladding and for diffusion welding the coating material and the wrapping material within the first cladding to form a substantially unitary coating material with the plurality of metallic wires contained therein;

mechanically removing the tube to provide a first remainder comprising the diffusion welded coating material and the wrapping material with the plurality of metallic wires contained therein;

drawing the first remainder for reducing the diameter thereof and for reducing the corresponding cross-section of each of the plurality of metallic wires contained therein to transform the plurality of metallic wires into a plurality of fine metallic fibers;

assembling a plurality of the drawn first remainders;

forming a continuous tube about the assembly of drawn first remainders for providing a second cladding;

encasing the assembly of the drawn first remainders with a wrapping material for providing a second bound assembly;

forming a continuous tube about the second bound assembly for providing a second cladding;

drawing the second cladding for reducing the outer diameter thereof and for reducing the cross-section of each of the plurality of fine metallic fibers within the second cladding and for diffusion welding the coating material and the wrapping material within the second cladding to form a substantially unitary coating material with the plurality of fine metallic fibers contained therein;

mechanically removing the tube to provide a second remainder comprising the diffusion welded coating material and the wrapping material with the plurality of fine metallic fibers contained therein;

drawing the second remainder for reducing the diameter thereof and for reducing the corresponding cross-section of each of the plurality of fine metallic fibers contained therein to transform the plurality of fine metallic fibers into a plurality of ultra fine metallic fibers; and removing the diffusion welded coating material and the wrapping material from the remainder for providing the plurality of ultra fine metallic fibers.

* * * * *